US011199347B2

(12) United States Patent
Ishiyama et al.

(10) Patent No.: US 11,199,347 B2
(45) Date of Patent: Dec. 14, 2021

(54) OIL SEPARATION DEVICE AND REFRIGERATION CYCLE APPARATUS

(71) Applicant: Mitsubishi Electric Corporation, Tokyo (JP)

(72) Inventors: Hiroki Ishiyama, Tokyo (JP); Yusuke Shimazu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 97 days.

(21) Appl. No.: 16/491,634

(22) PCT Filed: May 10, 2017

(86) PCT No.: PCT/JP2017/017647
§ 371 (c)(1),
(2) Date: Sep. 6, 2019

(87) PCT Pub. No.: WO2018/207274
PCT Pub. Date: Nov. 15, 2018

(65) Prior Publication Data

US 2020/0056818 A1 Feb. 20, 2020

(51) Int. Cl.
*F25B 43/02* (2006.01)
*F25B 31/00* (2006.01)

(52) U.S. Cl.
CPC ..... *F25B 43/02* (2013.01); *F25B 31/004* (2013.01)

(58) Field of Classification Search
CPC ..... F25B 43/02; F25B 13/00; F25B 31/004; F25B 31/006; F25B 31/002; F25B 43/006; F25B 2600/2523; F25B 2700/03; F25B 2500/16; F25B 2400/16; F25B 2400/23; F25B 41/20
(Continued)

(56) References Cited

U.S. PATENT DOCUMENTS 4,478,050 A 10/1984 DiCarlo et al.
5,502,984 A 4/1996 Boehde et al.
(Continued)

FOREIGN PATENT DOCUMENTS

CN 103946646 A * 7/2014 ..... F25B 1/10
CN 103946646 A 7/2014
(Continued)

OTHER PUBLICATIONS

The pdf file attached is the translation of foreign referecne JPS61147072A (Year: 1986).*
(Continued)

*Primary Examiner* — Henry T Crenshaw
*Assistant Examiner* — Kamran Tavakoldavani
(74) *Attorney, Agent, or Firm* — Posz Law Group, PLC

(57) ABSTRACT

An oil separation device includes a container, an inlet pipe, an outlet pipe, an oil return pipe, and an oil return regulating valve. The container includes a separation chamber, a storage chamber, and a partition portion. The oil return regulating valve is connected to the oil return pipe. The partition portion is configured to allow the refrigeration oil separated from the fluid mixture to flow from the separation chamber to the storage chamber. The oil return regulating valve is configured to regulate the quantity of refrigeration oil that is returned from the storage chamber to the compressor.

10 Claims, 21 Drawing Sheets

(58) Field of Classification Search
USPC ..... 62/470
See application file for complete search history.

(56) References Cited

U.S. PATENT DOCUMENTS

| | | | | |
|---|---|---|---|---|
| 7,810,351 | B2 | 10/2010 | Westermeyer | |
| 2009/0071188 | A1* | 3/2009 | Kusada | F25B 43/02 62/470 |
| 2017/0276415 | A1 | 9/2017 | Ishiyama et al. | |

FOREIGN PATENT DOCUMENTS

| | | | | | |
|---|---|---|---|---|---|
| EP | 1443286 | A1 | | 8/2004 | |
| JP | S52-40053 | | | 3/1977 | |
| JP | S56-90680 | | | 7/1981 | |
| JP | H-0611214 | A | * | 1/1984 | F25B 1/00 |
| JP | S-61147072 | A | * | 7/1986 | F25B 1/00 |
| JP | S-61147072 | A | * | 9/1986 | F25B 1/00 |
| JP | H02-40947 | B2 | | 9/1990 | |
| JP | H06-11214 | A | | 1/1994 | |
| JP | 2003-130474 | A | | 5/2003 | |
| JP | 2003130474 | A | * | 5/2003 | F04B 39/023 |
| JP | 2005-076902 | A | | 3/2005 | |
| JP | 2015-038407 | A | | 2/2015 | |
| JP | 2015-169381 | A | | 9/2015 | |
| JP | 2015-215148 | A | | 12/2015 | |
| JP | 2016-176664 | A | | 10/2016 | |
| WO | 2016/063400 | A1 | | 4/2016 | |

OTHER PUBLICATIONS

The pdf file attached is the translation of foreign reference CN103946646A (Year: 2014).*

Office Action dated Oct. 29, 2020 issued in corresponding CN patent application No. 201780090173.9 (and English machine translation).

Office Action dated Nov. 10, 2020 issued in corresponding JP patent application No. 2019-516785 (and English translation).

International Search Report of the International Searching Authority dated Jul. 18, 2017 for the corresponding International application No. PCT/JP2017/017647(and English translation).

Chinese Office Action dated Apr. 16, 2021, issued in corresponding CN Patent Application No. 201780090173.9 (and English Machine Translation).

Japanese Office Action dated May 11, 2021, issued in corresponding JP Patent Application No. 2019-516785 (and English Machine Translation).

Chinese Office Action dated Aug. 4, 2021, issued in corresponding CN Patent Application No. 201780090173.9 (and English Machine Translation).

* cited by examiner

OIL SEPARATION DEVICE AND REFRIGERATION CYCLE APPARATUS

CROSS REFERENCE TO RELATED APPLICATION

This application is a U.S. national stage application of International Application PCT/JP2017/017647, filed on May 10, 2017, the contents of which are incorporated herein by reference.

TECHNICAL FIELD

The present invention relates to an oil separation device and a refrigeration cycle apparatus.

BACKGROUND

In a compressor included in a refrigeration cycle apparatus, lubricating oil (refrigeration oil) is enclosed. During operation of the refrigeration cycle apparatus, the refrigeration oil flows out of the compressor together with refrigerant. If the refrigeration oil in the compressor is depleted by flowing out of the compressor, the reliability of the compressor is decreased. Further, the refrigeration oil flowing out of the compressor and then flowing into a pipe in a heat exchanger causes the degradation in heat-transfer performance and the increase in pressure loss at the heat exchanger. This causes the degradation in heat-exchange performance of the heat exchanger.

Accordingly, a conventional refrigeration cycle apparatus includes an oil separation device for separating the refrigeration oil and the refrigerant flowing out of the compressor. The refrigeration oil separated from the refrigerant by the oil separation device is returned from the oil separation device to the compressor. This can prevent the depletion of refrigeration oil in the compressor, thus preventing the decrease in reliability of the compressor. Also, since the refrigeration oil and the refrigerant flowing out of the compressor are separated by the oil separation device, the refrigeration oil can be prevented from flowing into a pipe in a heat exchanger, together with the refrigerant. This can prevent the degradation in heat-transfer performance and the increase in pressure loss at the heat exchanger.

The quantity of refrigeration oil flowing out of the compressor varies depending on the operation status of the compressor. Depending on the operation status of the compressor, a large quantity of refrigeration oil stays in the oil separation device, thus degrading the efficiency of separation between the refrigerant and the refrigeration oil. For example, Japanese Patent Laying-Open No. 2015-215148 (PTL 1) proposes an oil separation device including a partition plate partitioning the oil separation device into a separation chamber for separating the refrigeration oil from the refrigerant, and a storage chamber for storing the refrigeration oil separated from the refrigerant.

PATENT LITERATURE

PTL 1: Japanese Patent Laying-Open No. 2015-215148

However, the oil separation device in the above-described document may suffer from an overflow in which the refrigeration oil separated from the refrigerant accumulates in the storage chamber in such a large quantity that the liquid level of the refrigeration oil exceeds the partition plate level. Such an overflow degrades the efficiency of separation between the refrigerant and the refrigeration oil. The degradation in efficiency of separation between the refrigerant and the refrigeration oil due to the overflow causes the refrigeration oil to flow from the oil separation device into a pipe in a heat exchanger. This causes the degradation in heat-transfer performance and the increase in pressure loss at the heat exchanger.

SUMMARY

The present invention has been made in view of the above-described problems. An object of the present invention is to provide an oil separation device that can prevent the degradation in efficiency of separation between the refrigerant and the refrigeration oil, and to provide a refrigeration cycle apparatus including such an oil separation device.

An oil separation device of the present invention is for separating refrigeration oil from a fluid mixture of refrigerant and refrigeration oil discharged from a compressor. The oil separation device includes a container, an inlet pipe, an outlet pipe, an oil return pipe, and an oil return regulating valve. The container includes a separation chamber for separating the refrigeration oil from the fluid mixture, a storage chamber for storing the refrigeration oil separated from the fluid mixture, and a partition portion partially separating the separation chamber and the storage chamber from each other. The inlet pipe is configured to allow the fluid mixture to flow into the separation chamber of the container. The outlet pipe is configured to allow the refrigerant to flow out of the separation chamber, the refrigerant being separated from the fluid mixture that flows into the separation chamber through the inlet pipe. The oil return pipe is configured to return the refrigeration oil from the storage chamber to the compressor, the refrigeration oil being separated from the refrigerant that flows out through the outlet pipe. The oil return regulating valve is connected to the oil return pipe. The partition portion is configured to allow the refrigeration oil to flow from the separation chamber to the storage chamber, the refrigeration oil being separated from the fluid mixture. The oil return regulating valve is configured to regulate a quantity of the refrigeration oil that is returned from the storage chamber to the compressor.

According to the oil separation device of the present invention, the quantity of refrigeration oil that is returned from the storage chamber to the compressor is regulated by the oil return regulating valve, and thus the quantity of refrigeration oil stored in the storage chamber is regulated. This can prevent the occurrence of an overflow in which the liquid level of refrigeration oil stored in the storage chamber exceeds the level of the partition portion. Thus, the degradation in efficiency of separation between the refrigerant and the refrigeration oil can be prevented.

DETAILED DESCRIPTION

Hereinafter embodiments of the present invention are described with reference to the drawings.

Embodiment 1

Figure 1:
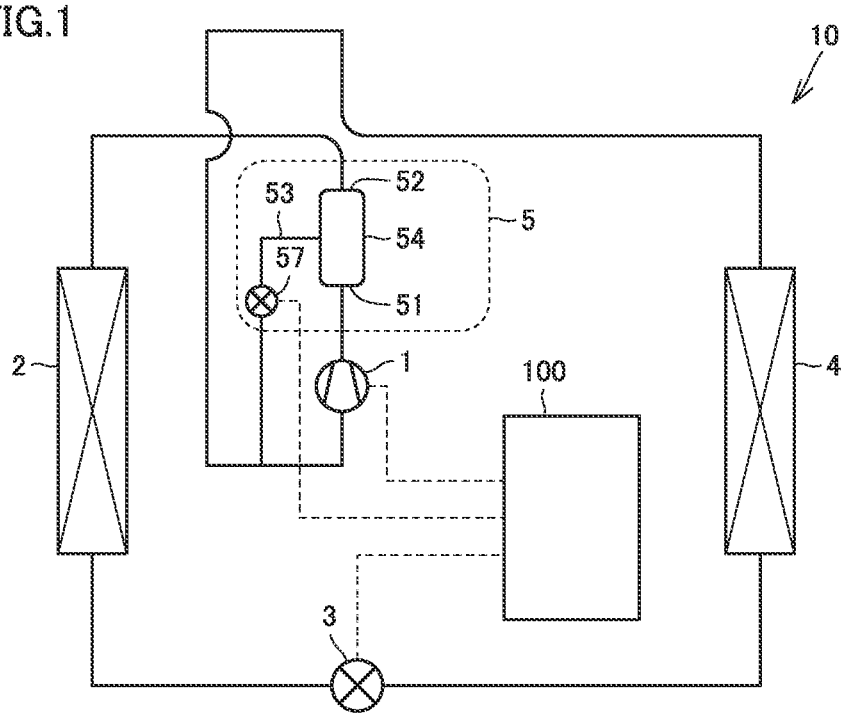
FIG. 1 is a refrigerant circuit diagram of a refrigeration cycle apparatus according to embodiment 1 of the present invention.
Figure 2:
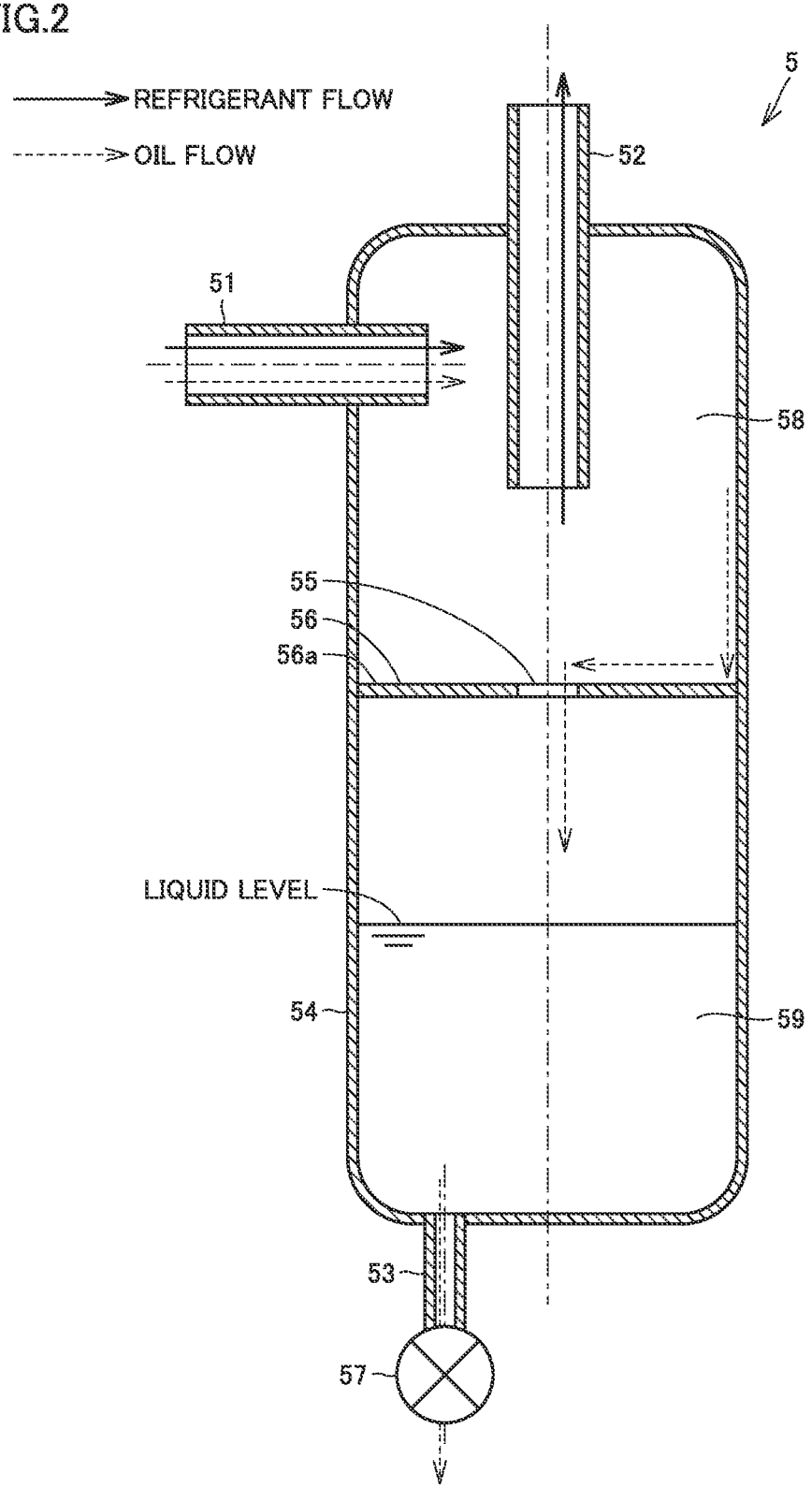
FIG. 2 is a cross-sectional view of an oil separation device according to embodiment 1 of the present invention.
Figure 3:
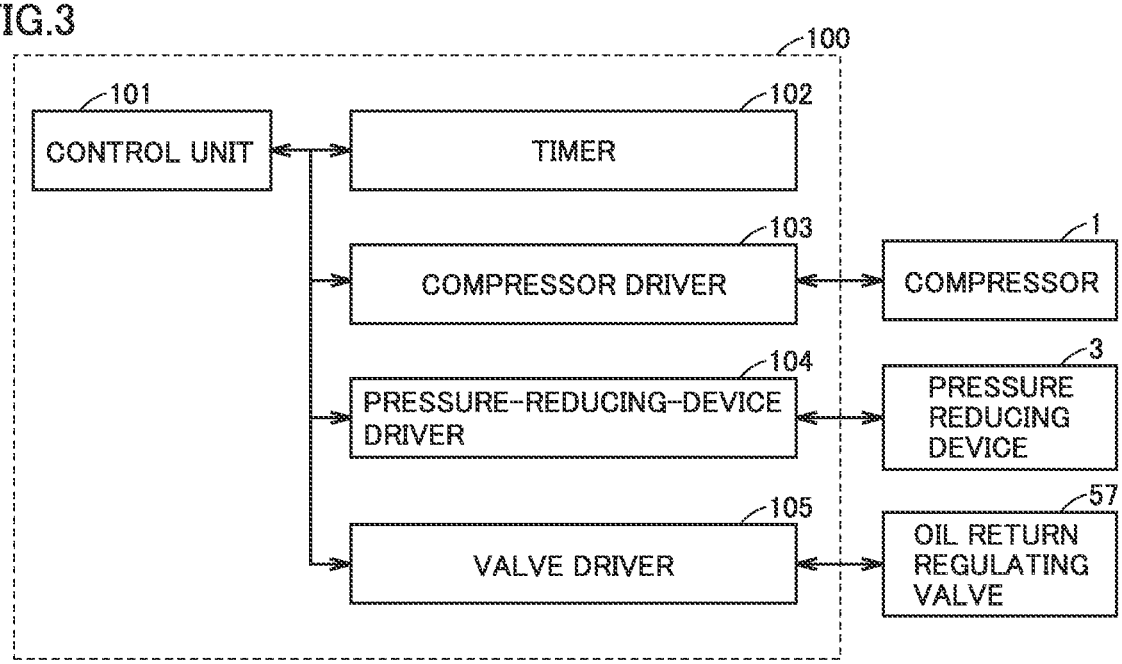
FIG. 3 is a functional block diagram of a refrigeration cycle apparatus according to embodiment 1 of the present invention.

With reference to FIG. 1 to FIG. 3, the configuration of a refrigeration cycle apparatus 10 in embodiment 1 of the present invention is described.

As shown in FIG. 1, refrigeration cycle apparatus 10 in the present embodiment mainly includes a compressor 1, a high-pressure-side heat exchanger 2, a pressure reducing device 3, a low-pressure-side heat exchanger 4, an oil separation device 5, and a control device 100.

Compressor 1, high-pressure-side heat exchanger 2, pressure reducing device 3, and low-pressure-side heat exchanger 4 are connected via pipes in this order. A refrigerant circuit is thus formed. Refrigerant flows through compressor 1, high-pressure-side heat exchanger 2, pressure reducing device 3, and low-pressure-side heat exchanger 4 in this order in the refrigerant circuit.

Compressor 1 is configured to compress the incoming refrigerant and discharge the compressed refrigerant. Compressor 1, in which refrigeration oil is enclosed, is configured to discharge a fluid mixture of refrigerant and refrigeration oil. The capacity of compressor 1 is variable. In the present embodiment, the number of rotations of compressor 1 is variably controlled. Specifically, the number of rotations of compressor 1 is regulated by varying the driving frequency based on the instruction from control device 100. The capacity of compressor 1 thus varies. The capacity of compressor 1 is the rate of sending the refrigerant per unit time. That is, compressor 1 can operate with varied capacity. For example, in a high-capacity operation, the driving frequency of compressor 1 is set to a high level, so that the refrigerant circulates through the refrigerant circuit at a high flow rate. In a low-capacity operation, the driving frequency of compressor 1 is set to a low level, so that the refrigerant circulates through the refrigerant circuit at a low flow rate.

High-pressure-side heat exchanger 2 is configured to condense the refrigerant compressed by compressor 1. For example, high-pressure-side heat exchanger 2 is an air heat exchanger constituted of pipes and fins. Pressure reducing device 3 is configured to reduce the pressure of the refrigerant condensed by high-pressure-side heat exchanger 2. That is, pressure reducing device 3 serves as an expansion valve. Pressure reducing device 3 is, for example, a solenoid valve. Low-pressure-side heat exchanger 4 is configured to vaporize the refrigerant reduced in pressure by pressure reducing device 3. For example, low-pressure-side heat exchanger 4 is an air heat exchanger constituted of pipes and fins.

Oil separation device 5 is for separating refrigeration oil from the fluid mixture of refrigerant and refrigeration oil discharged from compressor 1. As shown in FIG. 1 and FIG. 2, oil separation device 5 mainly includes an inlet pipe 51, an outlet pipe 52, an oil return pipe 53, a container 54, and an oil return regulating valve 57.

Container 54 includes a partition portion 56, a separation chamber 58, and a storage chamber 59. Container 54 has a cylindrical shape. Container 54 has an internal space. Container 54 is divided into separation chamber 58 and storage chamber 59 by partition portion 56. Specifically, partition portion 56 partially separates separation chamber 58 and storage chamber 59 from each other. Partition portion 56 is configured to allow the refrigeration oil from separation chamber 58 to storage chamber 59, the refrigeration oil being separated from the fluid mixture. Partition portion 56 includes a partition plate **56*a* separating separation chamber 58 and storage chamber 59 from each other. Partition plate 56*a* partitions the space into separation chamber 58 and storage chamber 59. Partition portion 56 has an opening 55 provided in partition plate 56*a*. Opening 55 is located in the center of partition plate 56*a*. Opening 55 is configured to allow communication between separation chamber 58 and storage chamber 59. Opening 55 extends through partition portion 56 from the separation chamber 58 side to the storage chamber 59 side. That is, separation chamber 58 and storage chamber 59 are not completely separated from each other. Separation chamber 58 is for separating refrigeration oil from the fluid mixture. Storage chamber 59** is configured to store the refrigeration oil separated from the fluid mixture.

Inlet pipe 51 is configured to allow the fluid mixture to flow into separation chamber 58. An end of inlet pipe 51 is disposed in separation chamber 58 of container 54. Inlet pipe 51 is connected to a side face of container 54. Inlet pipe 51 is connected to compressor 1 via a pipe.

Outlet pipe 52 is configured to allow the refrigerant to flow out of separation chamber 58, the refrigerant being separated from the fluid mixture that flows into separation chamber 58 through inlet pipe 51. An end of outlet pipe 52 is disposed in separation chamber 58 of container 54. Outlet pipe 52 is connected to the upper face of container 54. Outlet pipe 52 is connected to high-pressure-side heat exchanger 2 via a pipe.

Oil return pipe 53 is configured to return the refrigeration oil from storage chamber 59 to compressor 1, the refrigeration oil being separated from the refrigerant that flows out through outlet pipe 52. An end of oil return pipe 53 is disposed in storage chamber 59 of container 54. Oil return pipe 53 is connected to a low-pressure pipe via oil return regulating valve 57, the low-pressure pipe being disposed between compressor 1 and low-pressure-side heat exchanger 4.

Oil return regulating valve 57 is connected to oil return pipe 53. Oil return regulating valve 57 is disposed between oil return pipe 53 and the low-pressure pipe. Oil return regulating valve 57 is configured to regulate the quantity of refrigeration oil that is returned from storage chamber 59 to compressor 1. Oil return regulating valve 57 is configured to have a larger valve opening degree when the frequency change amount of compressor 1 is equal to or more than a prescribed change amount, than when the frequency change amount of compressor 1 is less than the prescribed change amount.

Examples of operations that involve a risk of depletion of refrigeration oil in compressor 1 include the start-up, the defrosting operation, and the intermittent operation. That is, there is a risk of depletion of refrigeration oil in compressor 1 when the frequency of compressor 1 rises from 0 Hz and when the operation mode clearly changes. For example, at the time of start-up of compressor 1, the frequency increases from 0 to 48 Hz in the first minute and subsequently increases by 10 Hz every minute. During a stable time and when the temperature has become close to the preset temperature, a frequency change by equal to or more than 10 Hz in one minute hardly occurs. Accordingly, for these periods, the prescribed change amount in frequency of compressor 1 is set to 10 Hz.

Control device 100 is configured to control each means, device and the like in refrigeration cycle apparatus 10 by performing mathematical operations and providing instructions. In particular, control device 100 is electrically connected to compressor 1, pressure reducing device 3, and oil return regulating valve 57, and is configured to control the operations of these components.

Next, with reference to FIG. 3, control device 100 in the present embodiment is described in more detail. As shown in FIG. 3, control device 100 mainly includes a control unit 101, a timer 102, a compressor driver 103, a pressure-reducing-device driver 104, and a valve driver 105. Control unit 101 is for controlling timer 102, compressor driver 103, pressure-reducing-device driver 104, and valve driver 105.

Timer 102 is for measuring time and sending a signal based on the time to control unit 101. Compressor driver 103 is for driving compressor 1 based on the signal from control unit 101. Specifically, compressor driver 103 controls the number of rotations of a motor (not shown) of compressor 1 by controlling the frequency of AC current flowing through the motor of compressor 1.

Pressure-reducing-device driver 104 is for driving pressure reducing device 3 based on the signal from control unit 101. Specifically, pressure-reducing-device driver 104 controls the valve opening degree of pressure reducing device 3 by controlling a driving source, such as a motor, attached to pressure reducing device 3.

Valve driver 105 is for driving oil return regulating valve 57 based on the signal from control unit 101. Specifically, valve driver 105 controls the valve opening degree of oil return regulating valve 57 by controlling a driving source, such as a motor, attached to oil return regulating valve 57.

Next, with reference to FIG. 1 and FIG. 2, the operation of refrigeration cycle apparatus 10 in the present embodiment is described.

As shown in FIG. 1 and FIG. 2, in refrigeration cycle apparatus 10 in the present embodiment, refrigerant flows through compressor 1, high-pressure-side heat exchanger 2, pressure reducing device 3, and low-pressure-side heat exchanger 4 in this order. Refrigerant also flows from compressor 1 to oil separation device 5.

The quantity of refrigeration oil required to be enclosed in compressor 1 (proper oil quantity) differs depending on the operation status. In particular, the proper oil quantity in compressor 1 differs between the stable time and the transition time. The stable time is the time of normal operation. The transition time is the time of operation when a transitional change occurs in the actuator, such as the time of start-up or the time of defrosting operation. The proper oil quantity for the stable time is smaller than the proper oil quantity for the transition time. Therefore, refrigeration oil enclosed in compressor 1 based on the proper oil quantity for the transition time would be in excess of the proper oil quantity for the stable time. The excessive refrigeration oil results in surplus oil.

Refrigeration cycle apparatus 10 in the present embodiment is configured to switch between a storing mode in which the refrigeration oil is stored in storage chamber 59 of oil separation device 5, and an oil return mode in which the refrigeration oil is returned from storage chamber 59 of oil separation device 5 to compressor 1.

In the oil return mode, the fluid mixture of refrigerant and refrigeration oil discharged from compressor 1 flows into oil separation device 5. The fluid mixture of refrigerant and refrigeration oil flows into container 54 through inlet pipe 51 of oil separation device 5. The refrigerant and the refrigeration oil are separated from each other in separation chamber 58 in container 54. The refrigerant separated in separation chamber 58 flows out of oil separation device 5 through outlet pipe 52, and then flows into high-pressure-side heat exchanger 2 through a pipe. The refrigeration oil separated in separation chamber 58 flows into storage chamber 59 through opening 55 of partition portion 56. The refrigeration oil that has flowed into storage chamber 59 flows out of storage chamber 59 to oil return pipe 53. The refrigeration oil that has flowed into oil return pipe 53 flows out of oil separation device 5 through oil return regulating valve 57, and then flows into the low-pressure pipe between compressor 1 and low-pressure-side heat exchanger 4. The refrigeration oil that has flowed into the low-pressure pipe is returned to compressor 1 through the low-pressure pipe.

In the storing mode, the refrigeration oil separated in separation chamber 58 flows into storage chamber 59 through opening 55 of partition portion 56, as in the oil return mode. A certain quantity of the refrigeration oil that has flowed into storage chamber 59 flows into oil return pipe 53, and the other refrigeration oil is stored in storage chamber 59. Accordingly, the liquid level of refrigeration oil accumulated in storage chamber 59 increases. The refrigeration oil that has flowed into oil return pipe 53 is returned to compressor 1 by the same route as that in the oil return mode.

When the flow rate of refrigeration oil flowing into oil separation device 5 is higher than the flow rate of refrigeration oil flowing into oil return pipe 53, the liquid level of refrigeration oil in oil separation device 5 increases. The phenomenon of the increase in liquid level up to separation chamber 58 is called an overflow. Progress in the overflow may increase the liquid level up to outlet pipe 52 and cause the refrigeration oil to flow out through outlet pipe 52. This extremely degrades the efficiency of separation between the refrigerant and the refrigeration oil.

Figure 4:
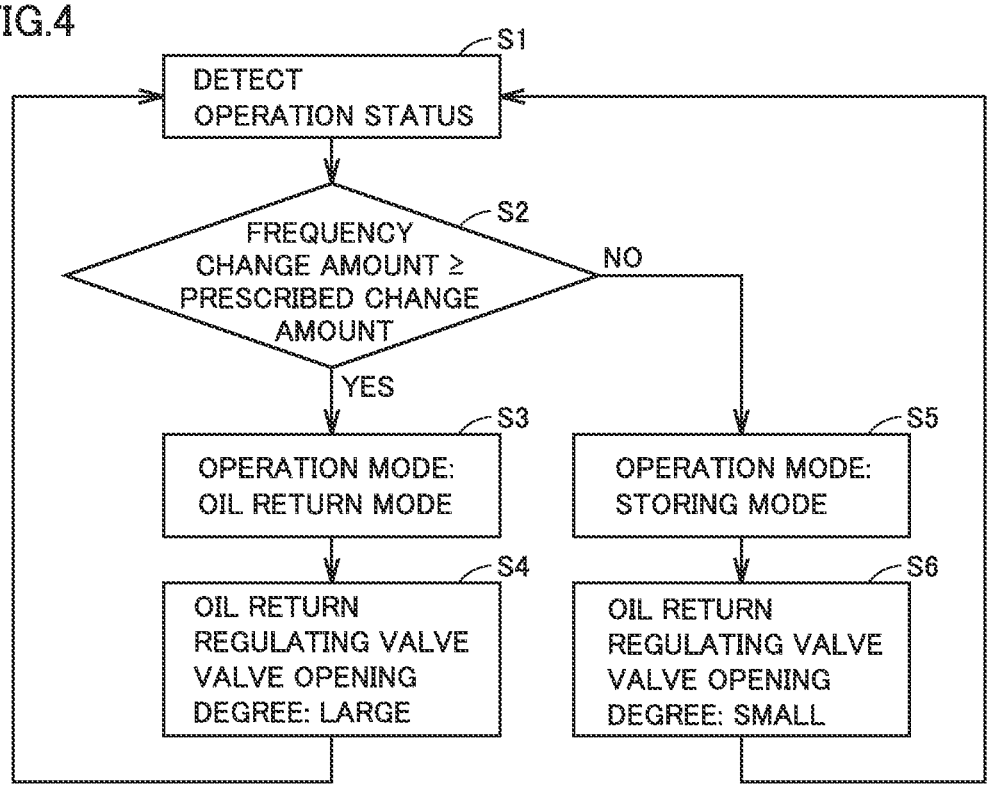
FIG. 4 is a flowchart showing the operation of a refrigeration cycle apparatus according to embodiment 1 of the present invention.

With reference to FIG. 3 and FIG. 4, the switching of the operation mode of refrigeration cycle apparatus 10 in the present embodiment will now be described.

First, the operation status of refrigeration cycle apparatus 10 is detected (step S1). Then, it is determined whether or not the frequency change amount of compressor 1 is equal to or more than a prescribed change amount (step S2). This determination is performed by control unit 101 based on the signals from timer 102 and compressor driver 103. When the frequency change amount of compressor 1 is equal to or more than the prescribed change amount, the operation mode is switched to the oil return mode (step S3). In the oil return mode, oil return regulating valve 57 is controlled to have a large valve opening degree by valve driver 105 based on the signal from control unit 101 (step S4). On the other hand, when the frequency change amount of compressor 1 is less than the prescribed change amount, the operation mode is switched to the storing mode (step S5). In the storing mode, oil return regulating valve 57 is controlled to have a small valve opening degree by valve driver 105 based on the signal from control unit 101 (step S6).

That is, the operation mode of refrigeration cycle apparatus 10 is switched from the storing mode to the oil return mode when the frequency of compressor 1 changes by equal to or more than a prescribed value. In the storing mode, control device 100 controls oil return regulating valve 57 to have a smaller valve opening degree than in the oil return mode. In the oil return mode, control device 100 controls oil return regulating valve 57 to have a larger valve opening degree than in the storing mode. That is, control device 100 controls the valve opening degree of oil return regulating valve 57 in accordance with the operation mode.

Next, the advantageous effects of the present embodiment are described.

According to oil separation device 5 in the present embodiment, the quantity of refrigeration oil that is returned from storage chamber 59 to compressor 1 is regulated by oil return regulating valve 57, and thus the quantity of refrigeration oil stored in storage chamber 59 is regulated. This can prevent the occurrence of an overflow in which the liquid level of refrigeration oil stored in storage chamber 59 exceeds the level of partition portion 56. Thus, the degradation in efficiency of separation between the refrigerant and the refrigeration oil can be prevented.

Further, since container 54 of oil separation device 5 includes storage chamber 59, surplus oil can be stored in oil separation device 5. This can more reliably prevent the refrigeration oil from flowing into a pipe in a heat exchanger, together with the refrigerant, as compared with the case with no oil separation device 5 in refrigeration cycle apparatus 10. This can prevent the degradation in heat-transfer performance and the increase in pressure loss at the heat exchanger. Thus, the heat-exchange performance at the heat exchanger can be enhanced.

Further, since container 54 of oil separation device 5 includes storage chamber 59, the refrigeration oil stays in storage chamber 59 in oil separation device 5. This can prevent the degradation in efficiency of separation between the refrigerant and the refrigeration oil, as compared with the case with no storage chamber 59 in refrigeration cycle apparatus 10.

Further, since container 54 of oil separation device 5 includes storage chamber 59, there is no need to provide another container for storing the refrigeration oil. This can save space as compared with the case with another container.

Further, the quantity of refrigeration oil flowing into storage chamber 59 is larger in the transition time during which the frequency change amount of compressor 1 is equal to or more than a prescribed change amount, than in the stable time during which the frequency change amount of compressor 1 is less than the prescribed change amount. According to oil separation device 5 in the present embodiment, oil return regulating valve 57 is configured to have a larger valve opening degree when the frequency change amount of compressor 1 is equal to or more than a prescribed change amount, than when the frequency change amount of compressor 1 is less than the prescribed change amount. This can prevent the occurrence of an overflow in which the liquid level of refrigeration oil stored in storage chamber 59 exceeds the level of partition portion 56.

Further, according to oil separation device 5 in the present embodiment, partition portion 56 has opening 55 to allow communication between separation chamber 58 and storage chamber 59. By allowing the refrigeration oil to flow from separation chamber 58 to storage chamber 59 through opening 55, the refrigeration oil can be separated from the refrigerant.

Next, variations of oil separation device 5 in the present embodiment are described. Unless otherwise noted, oil separation device 5 in each variation has the same configuration as oil separation device 5 in the present embodiment described above. Thus, identical components are identically denoted, and the explanation of the components is not repeated.

With reference to FIG. 5 to FIG. 8, oil separation device 5 in variation 1 of the present embodiment is described. Oil separation device 5 in variation 1 of the present embodiment uses a centrifugal separation system or a collision separation system to separate the refrigeration oil from the refrigerant.

The centrifugal separation system is one of the separation systems with a gas-liquid separator. The centrifugal separation system uses, as a principle of separation, a centrifugal force to generate a swirl flow of the fluid mixture of refrigerant and refrigeration oil. The refrigeration oil is trapped by the inner wall surface of the container in the gas-liquid separator and is separated from the refrigerant gas. Examples of centrifugal separation systems include a cyclonic system.

The collision separation system is one of the separation systems with a gas-liquid separator. In the collision separation system, the refrigerant gas and the refrigeration oil that have flowed into a gas-liquid separator collide against the inner wall surface. While the refrigeration oil is trapped by the inner wall surface, the refrigerant gas flows into the inlet pipe without being trapped by the inner wall surface. Thus, the refrigeration oil is separated from the refrigerant gas.

Figure 5:
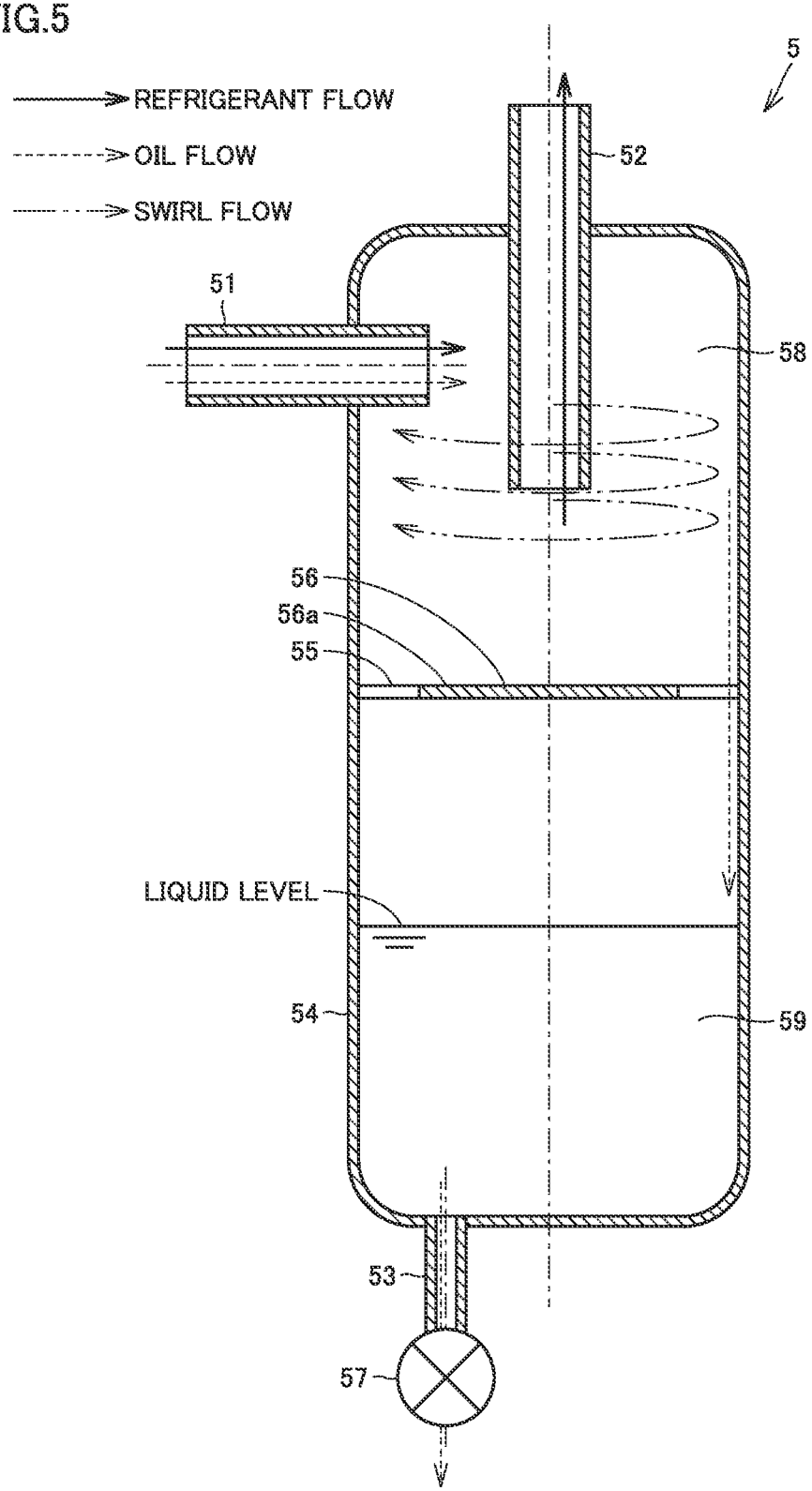
FIG. 5 is a cross-sectional view of a first oil separation device according to variation 1 of embodiment 1 of the present invention.

As shown in FIG. 5, a first oil separation device 5 in variation 1 of the present embodiment uses a centrifugal separation system to separate the refrigeration oil from the refrigerant. First oil separation device 5 in variation 1 of the present embodiment generates a swirl flow of the fluid mixture of refrigerant and refrigeration oil in separation chamber 58.

Container 54 has an inner wall surface. Inlet pipe 51 protrudes inward from the inner wall surface of container 54. The fluid mixture of refrigerant and refrigeration oil flows into container 54 through the inlet opening of inlet pipe 51 and flows as swirling along the inner wall surface. The refrigeration oil is trapped by the inner wall surface of container 54 and flows downward along the inner wall surface of container 54. Opening 55 is provided between the inner wall surface of container 54 and partition plate 56*a*. That is, opening 55 is provided at the connection part of partition portion 56 connected with the inner wall surface of container 54. Thus, opening 55 is located along the inner wall surface of container 54. The refrigeration oil flows from separation chamber 58 into storage chamber 59 through opening 55. The refrigerant separated from the refrigeration oil flows out of separation chamber 58 through outlet pipe 52.

Figure 6:
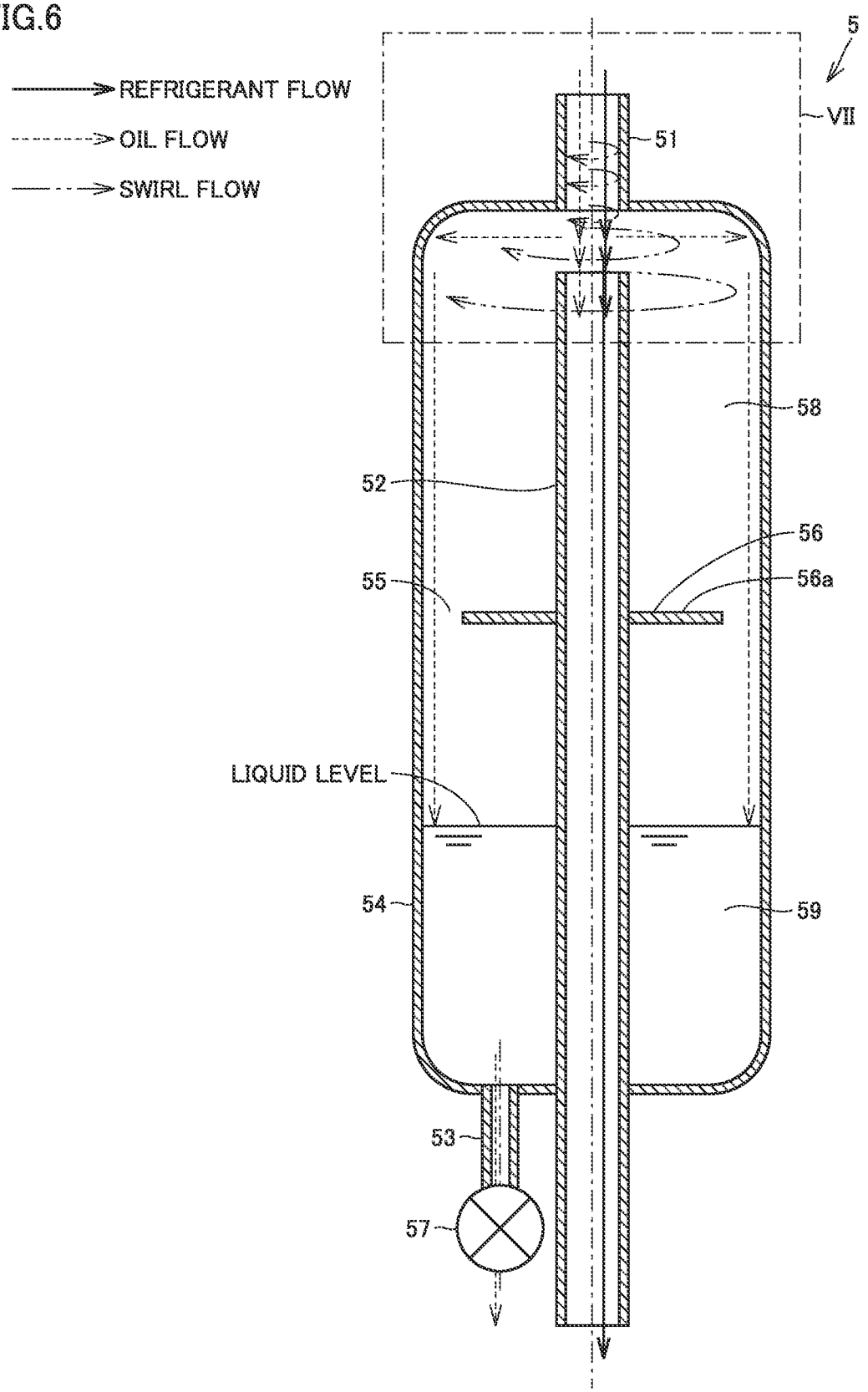
FIG. 6 is a cross-sectional view of a second oil separation device according to variation 1 of embodiment 1 of the present invention.
Figure 7:
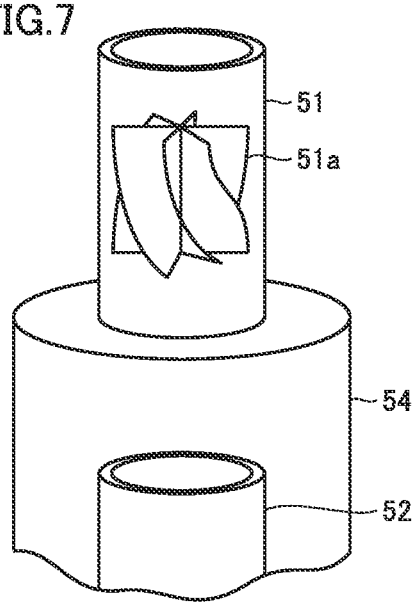
FIG. 7 is an enlarged perspective view of part VII in FIG. 6.

As shown in FIG. 6 and FIG. 7, a second oil separation device 5 in variation 1 of the present embodiment uses a centrifugal separation system to separate the refrigeration oil from the refrigerant. Second oil separation device 5 in variation 1 of the present embodiment generates a swirl flow of the fluid mixture of refrigerant and refrigeration oil in inlet pipe 51. Inlet pipe 51 includes a swirl portion 51*a* therein. Swirl portion 51*a* is, for example, a swirl vane. A swirl flow generated by this swirl vane flows into separation chamber 58. Inlet pipe 51 is preferably larger than outlet pipe 52 in inside diameter.

The refrigeration oil is trapped by the inner wall surface of container 54 and flows downward along the inner wall surface of container 54. The refrigeration oil flows from separation chamber 58 into storage chamber 59 through opening 55 provided between the inner wall surface of container 54 and partition plate 56*a*. The refrigerant separated from the refrigeration oil flows out of oil separation device 5 through outlet pipe 52.

Figure 8:
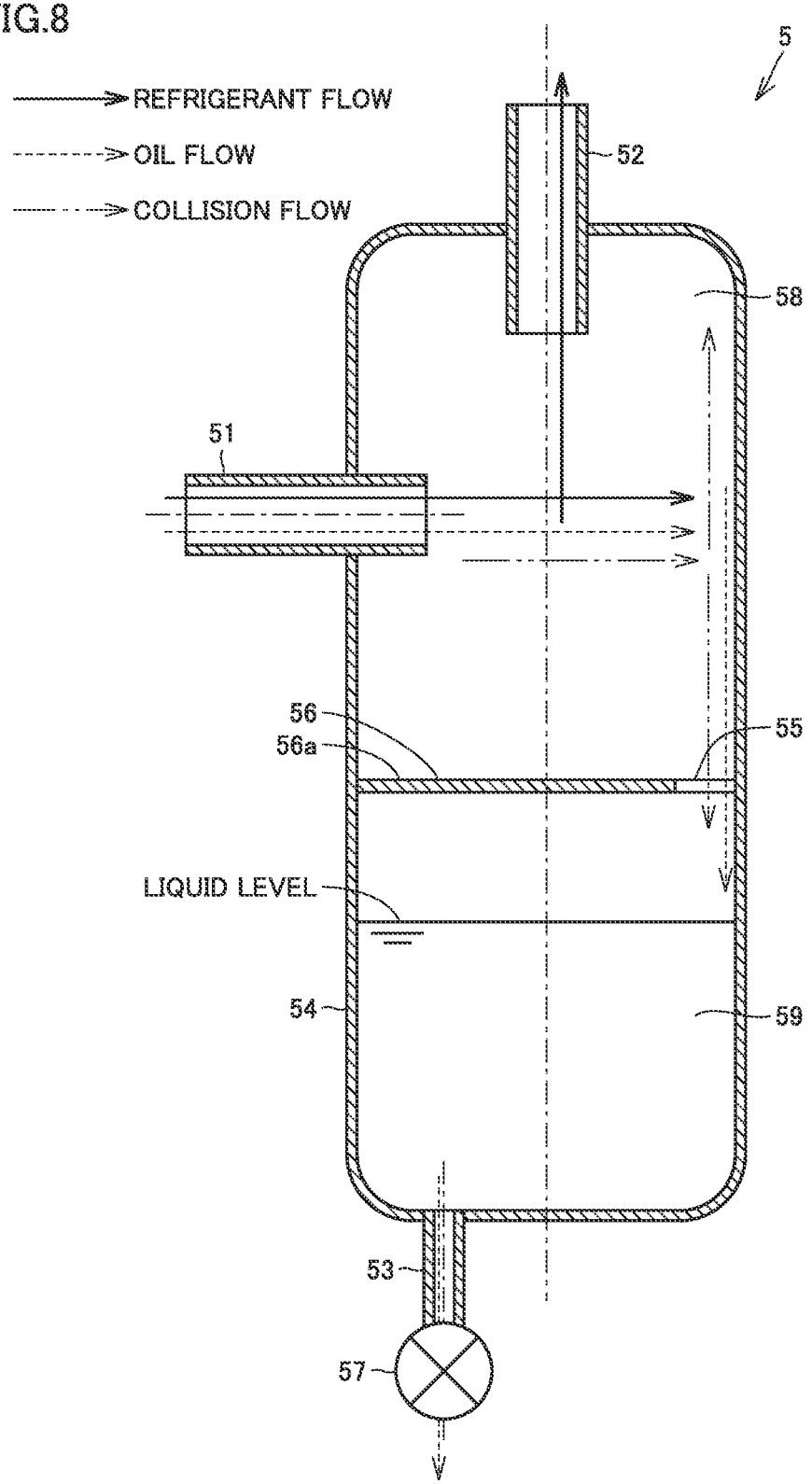
FIG. 8 is a cross-sectional view of a third oil separation device according to variation 1 of embodiment 1 of the present invention.

As shown in FIG. 8, a third oil separation device 5 in variation 1 of the present embodiment uses a collision separation system to separate the refrigeration oil from the refrigerant. In third oil separation device 5 in variation 1 of the present embodiment, the fluid mixture that has flowed into separation chamber 58 through inlet pipe 51 collides against the inner wall surface. The refrigeration oil is trapped by the inner wall surface and flows downward along the inner wall surface of container 54. The refrigeration oil flows from separation chamber 58 into storage chamber 59 through opening 55 provided between the inner wall surface of container 54 and partition plate 56*a*. The refrigerant flows out of separation chamber 58 through outlet pipe 52 without being trapped by the inner wall surface.

According to oil separation device 5 in variation 1 of the present embodiment, the refrigeration oil flows from separation chamber 58 to storage chamber 59 along the inner wall surface of container 54. Accordingly, the refrigeration oil can be prevented from staying in separation chamber 58. This can prevent the degradation in efficiency of separation between the refrigerant and the refrigeration oil.

Further, since opening 55 is provided between the inner wall surface and partition plate 56*a*, the refrigerant can be prevented from entering storage chamber 59. Thus, the pressure loss due to oil separation device 5 can be reduced.

Figure 9:
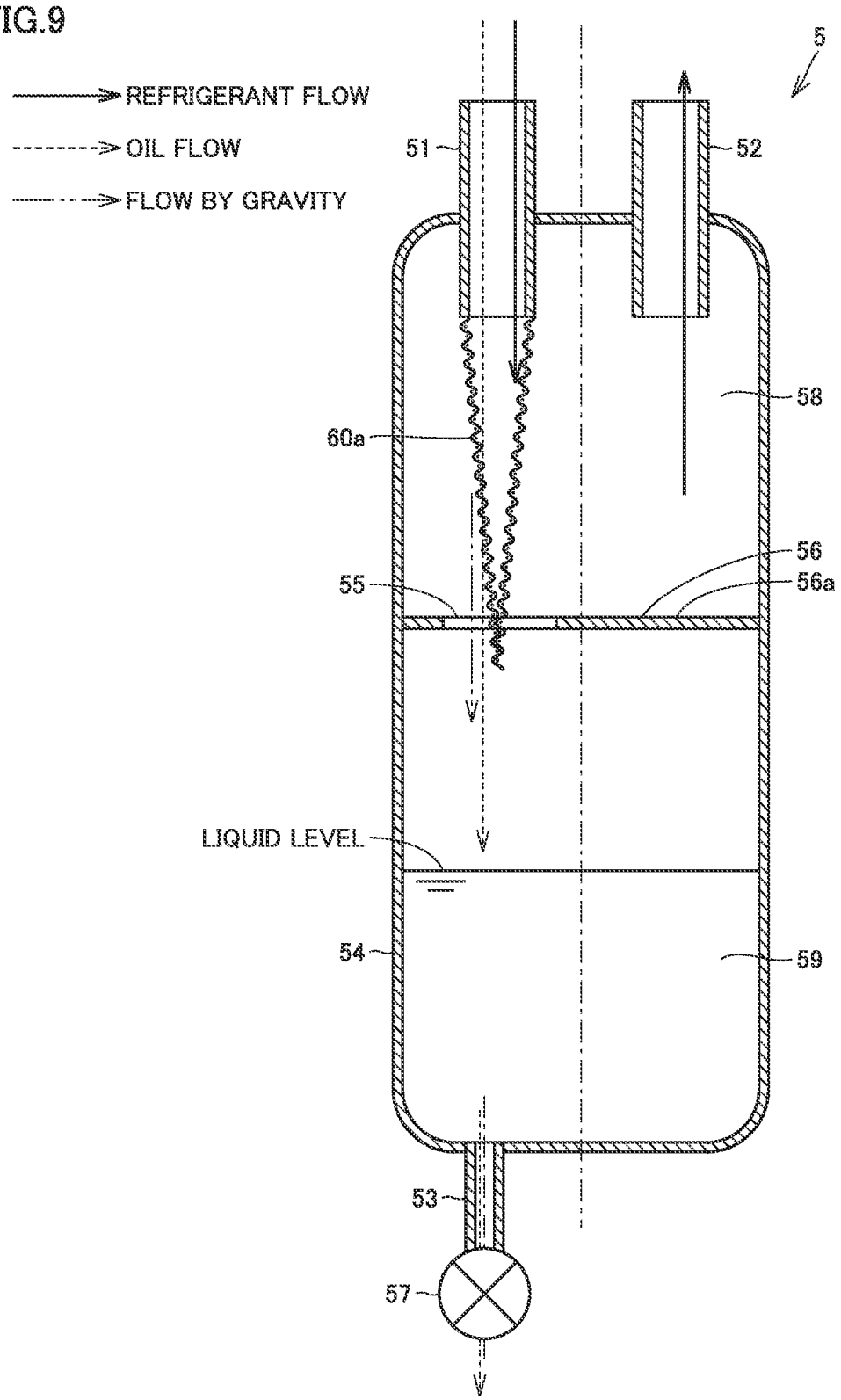
FIG. 9 is a cross-sectional view of an oil separation device according to variation 2 of embodiment 1 of the present invention.

With reference to FIG. 9, oil separation device 5 in variation 2 of the present embodiment is described. Oil separation device 5 in variation 2 of the present embodiment uses a gravity separation system to separate the refrigeration oil from the refrigerant. The gravity separation system is one of the separation systems with a gas-liquid separator. The refrigerant gas and the refrigeration oil flow into a trapping material 60*a*. Examples of trapping material 60*a* include a mesh. For example, trapping material 60*a* forms a conical surface. The base of the conical surface is connected to inlet pipe 51. The base of the conical surface is at the upper end of trapping material 60*a*, and the tip of the conical surface is at the lower end of trapping material 60*a*.

The refrigerant gas passes through trapping material 60*a* to flow into outlet pipe 52, whereas the refrigeration oil is trapped by trapping material 60*a*. The trapped refrigeration oil flows downward by gravity to oil return pipe 53. Thus, the refrigeration oil is separated from the refrigerant.

As shown in FIG. 9, in oil separation device 5 in variation 2 of the present embodiment, trapping material 60*a* traps the refrigeration oil floating in container 54 without colliding against the inner wall surface. The refrigeration oil trapped by trapping material 60*a* flows into storage chamber 59 through opening 55. Inlet pipe 51 has an inlet opening to allow the fluid mixture to flow into separation chamber 58. Opening 55 is located directly below the inlet opening of inlet pipe 51. Thus, the refrigeration oil trapped by trapping material 60*a* flows into storage chamber 59 through opening 55 by gravity.

According to oil separation device 5 in variation 2 of the present embodiment, opening 55 is located directly below the inlet opening of inlet pipe 51. Thus, the refrigeration oil can be prevented from staying in separation chamber 58. This can prevent the degradation in efficiency of separation between the refrigerant and the refrigeration oil. Also, since opening 55 is located at the place where the droplets of oil trapped by trapping material 60*a* pass, the refrigerant gas can be prevented from entering storage chamber 59. Thus, the pressure loss due to oil separation device 5 can be reduced.

With reference to FIG. 10 to FIG. 13, oil separation device 5 in variation 3 of the present embodiment is described. Oil separation device 5 in variation 3 of the present embodiment can use any of a centrifugal separation system, a collision separation system, and a gravity separation system.

Figure 10:
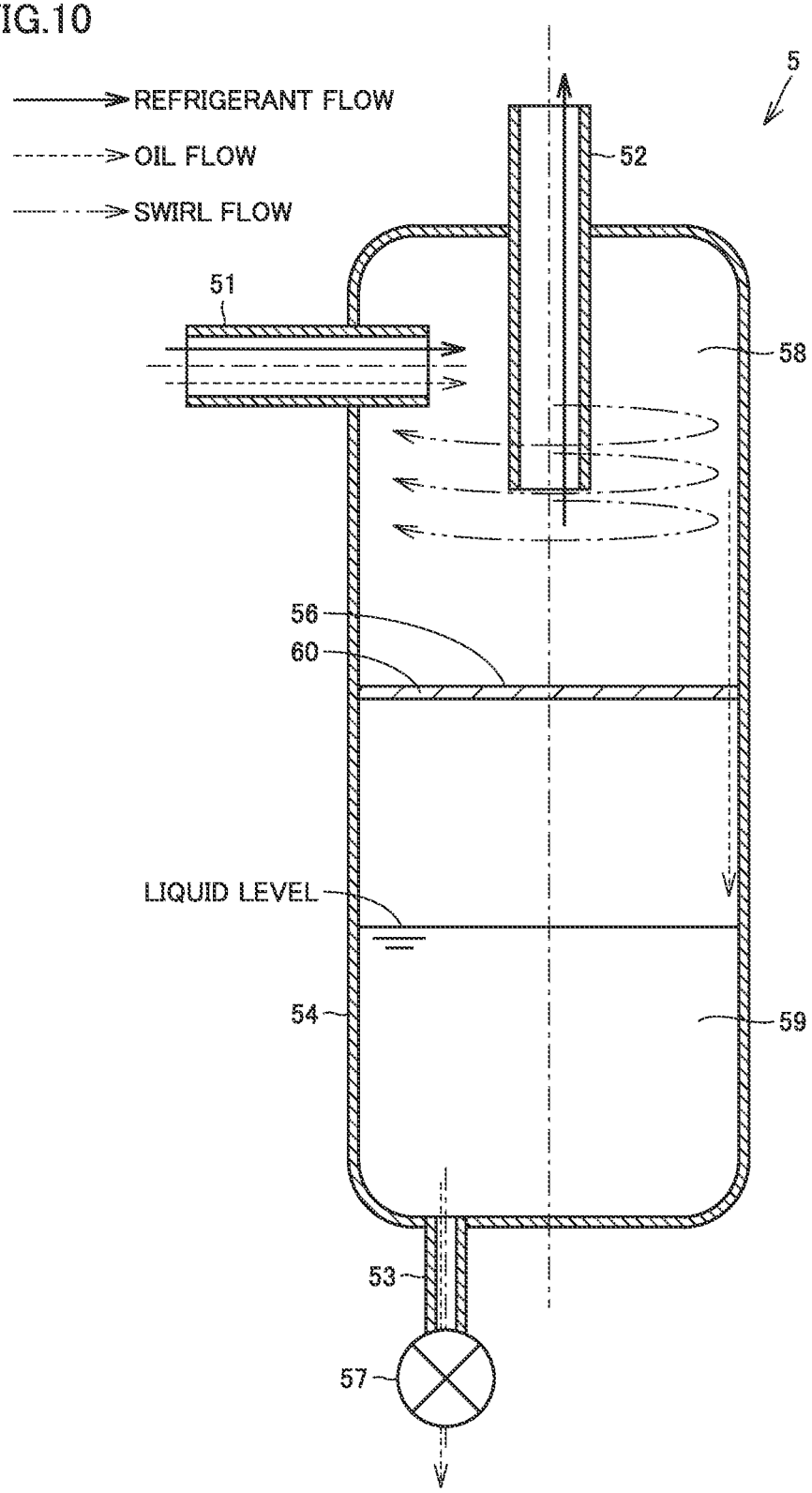
FIG. 10 is a cross-sectional view of a first oil separation device according to variation 3 of embodiment 1 of the present invention.

As shown in FIG. 10, a first oil separation device 5 in variation 3 of the present embodiment uses a centrifugal separation system to separate the refrigeration oil from the refrigerant. First oil separation device 5 in variation 3 of the present embodiment generates a swirl flow of the fluid mixture of refrigerant and refrigeration oil in separation chamber 58.

Figure 11:
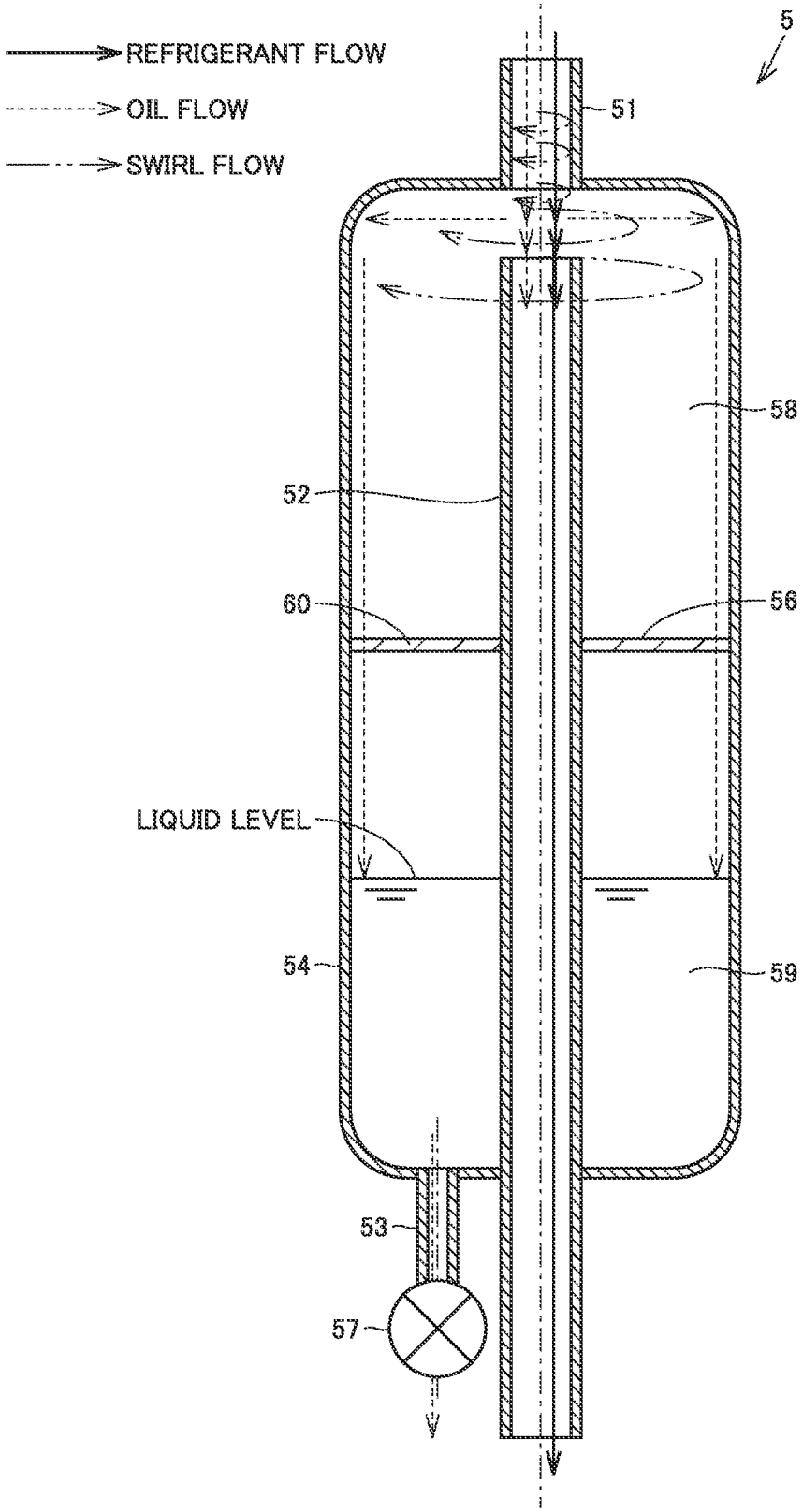
FIG. 11 is a cross-sectional view of a second oil separation device according to variation 3 of embodiment 1 of the present invention.

As shown in FIG. 11, a second oil separation device 5 in variation 3 of the present embodiment uses a centrifugal separation system to separate the refrigeration oil from the refrigerant. In second oil separation device 5 in variation 3 of the present embodiment, a swirl flow generated in inlet pipe 51 flows into separation chamber 58.

Figure 12:
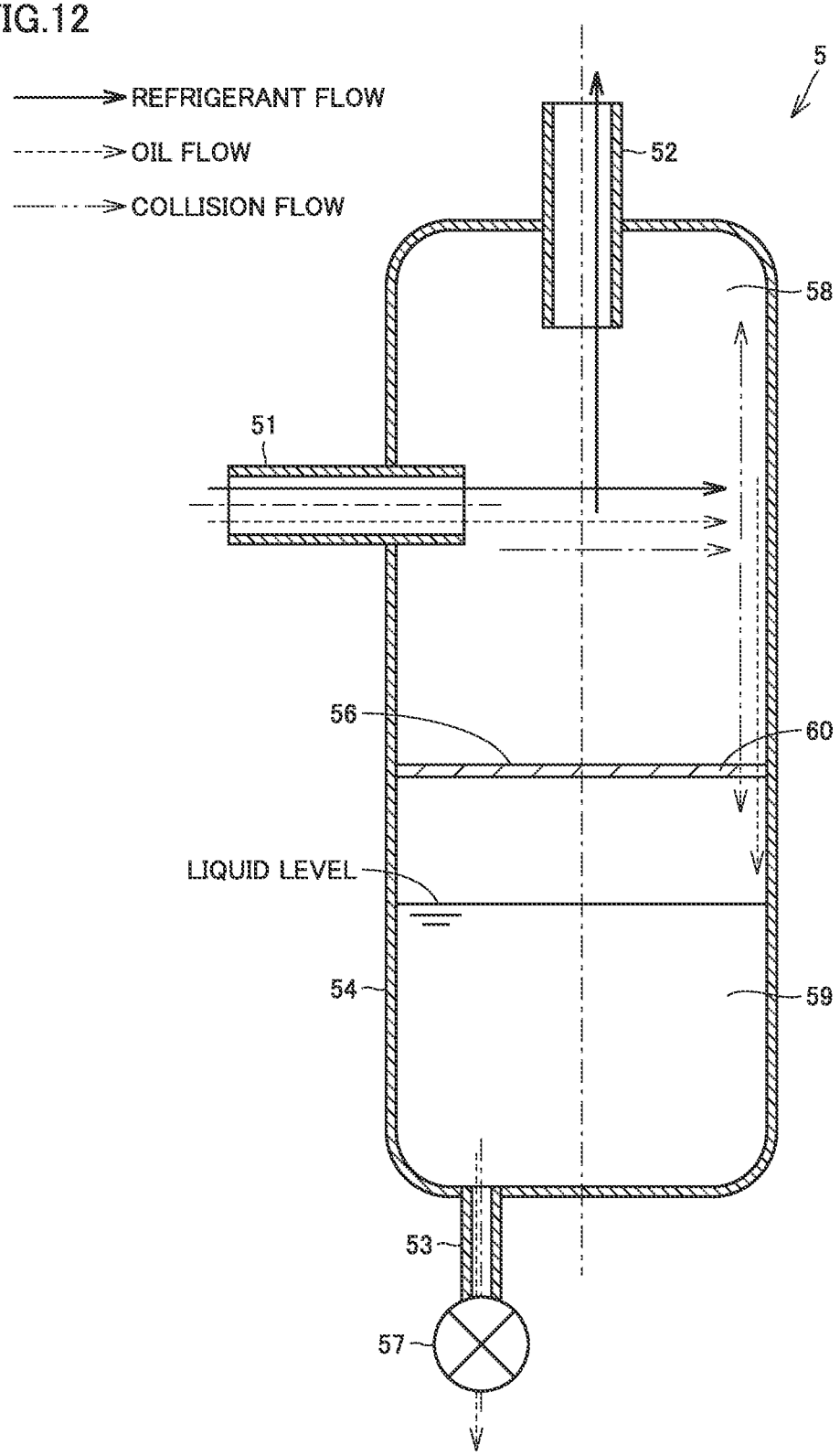
FIG. 12 is a cross-sectional view of a third oil separation device according to variation 3 of embodiment 1 of the present invention.

As shown in FIG. 12, a third oil separation device 5 in variation 3 of the present embodiment uses a centrifugal separation system to separate the refrigeration oil from the refrigerant. Third oil separation device 5 in variation 3 of the present embodiment generates a swirl flow in inlet pipe 51. This swirl flow flows into separation chamber 58.

Figure 13:
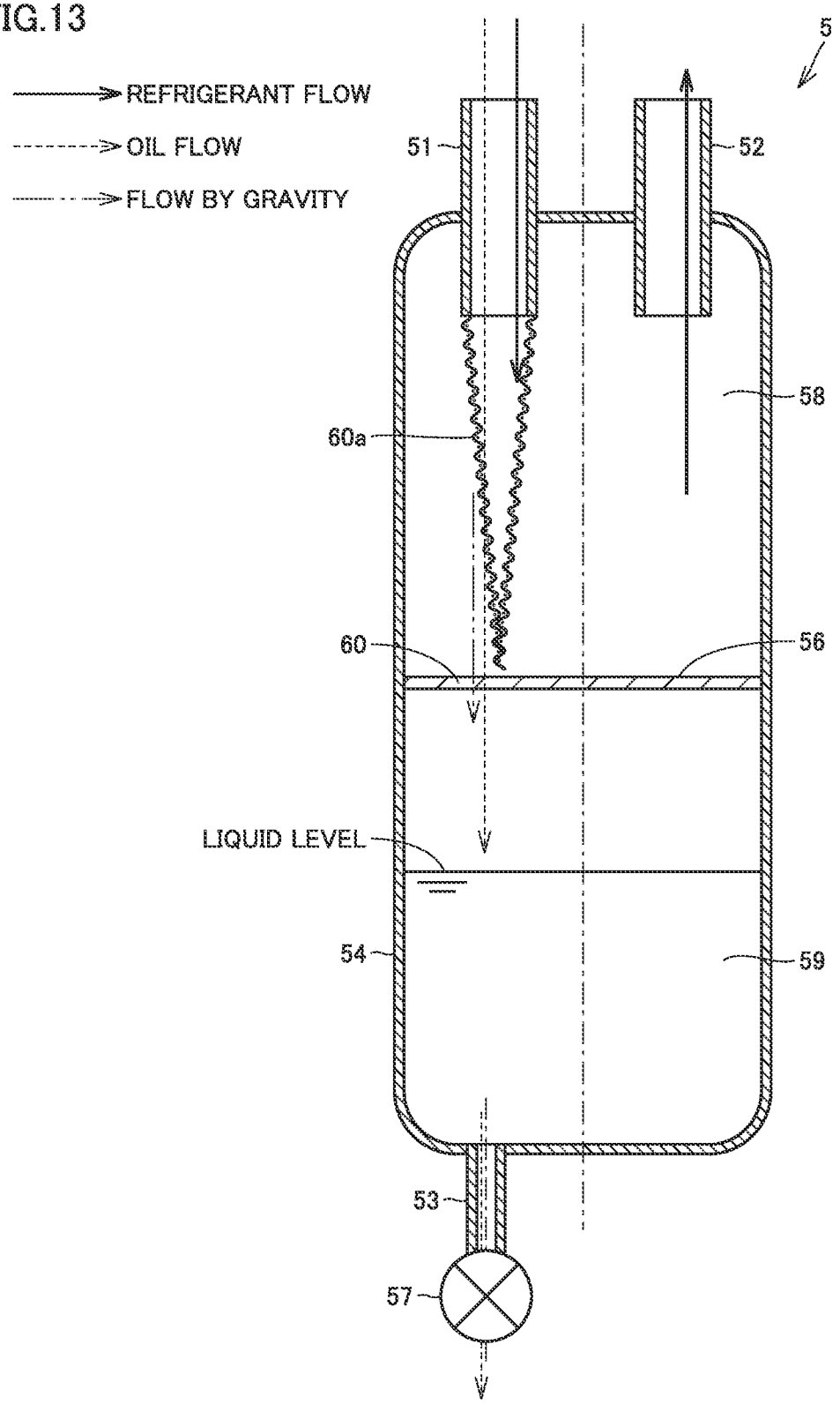
FIG. 13 is a cross-sectional view of a fourth oil separation device according to variation 3 of embodiment 1 of the present invention.

As shown in FIG. 13, a fourth oil separation device 5 in variation 3 of the present embodiment uses a gravity separation system to separate the refrigeration oil from the refrigerant. Fourth oil separation device 5 in variation 3 of the present embodiment allows the refrigerant gas and the refrigeration oil to flow into trapping material 60*a*. The refrigeration oil is trapped by trapping material 60*a*.

In any of the above-described separation systems, in oil separation device 5 in variation 3 of the present embodiment, partition portion 56 includes a trapping material 60 having a porosity such that trapping material 60 is permeable to the refrigeration oil. Trapping material 60 has a porosity equal to or more than a prescribed porosity that allows the refrigeration oil to move from separation chamber 58 to storage chamber 59. Trapping material 60 may be a stack of a plurality of meshes, for example. Alternatively, trapping material 60 may be foam metal, for example. The foam metal is a metal structure containing continuous air bubbles. That is, the foam metal has air permeability. Examples of the foam metal include aluminium. Partition portion 56 is configured to allow the refrigeration oil to flow from separation chamber 58 to storage chamber 59 through trapping material 60. All of or part of partition portion 56 may be made of trapping material 60.

According to oil separation device 5 in variation 3 of the present embodiment, partition portion 56 is configured to allow the refrigeration oil to flow from separation chamber 58 to storage chamber 59 through trapping material 60. This can prevent the refrigerant gas from entering storage chamber 59. Thus, the pressure loss due to oil separation device 5 can be reduced. Further, since opening 55 as in oil separation device 5 in the present embodiment is not provided, the refrigerant gas can be more reliably prevented from entering storage chamber 59, as compared with the case with opening 55.

Further, regardless of the separation system, the refrigeration oil can be prevented from staying in separation chamber 58. Thus, the degradation in efficiency of separation between the refrigerant and the refrigeration oil can be prevented regardless of the separation system.

Further, since trapping material 60 traps the refrigeration oil, the refrigeration oil can be prevented from scattering again. Thus, the efficiency of separation between the refrigerant and the refrigeration oil can be enhanced.

Embodiment 2

Figure 14:
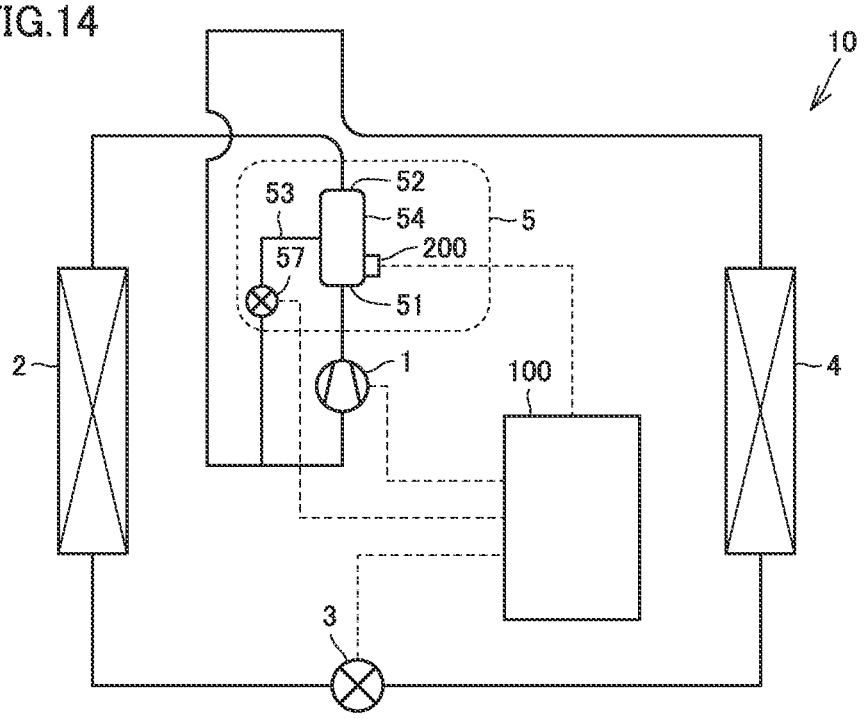
FIG. 14 is a refrigerant circuit diagram of a refrigeration cycle apparatus according to embodiment 2 of the present invention.
Figure 15:
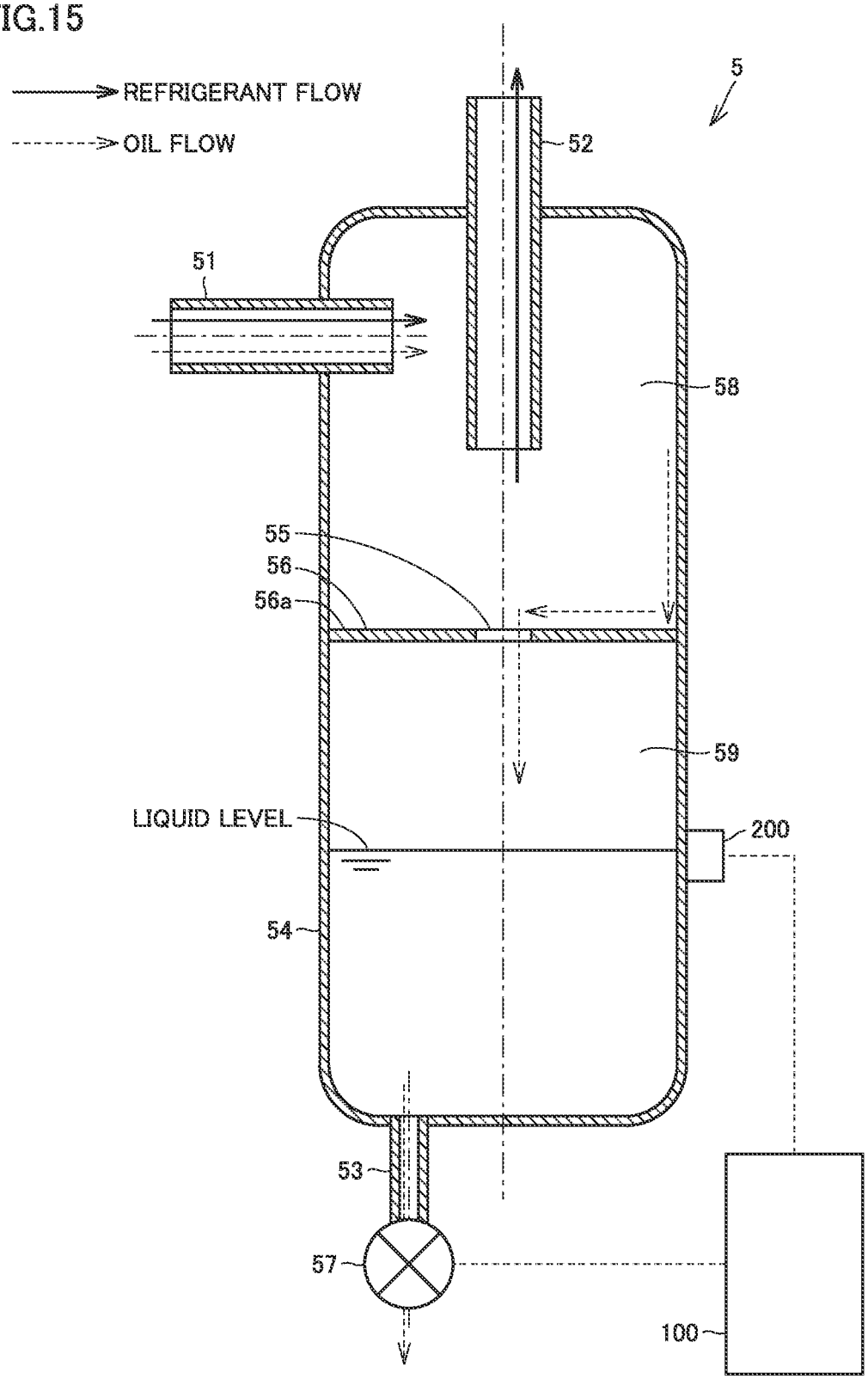
FIG. 15 is a cross-sectional view of an oil separation device according to embodiment 2 of the present invention.
Figure 16:
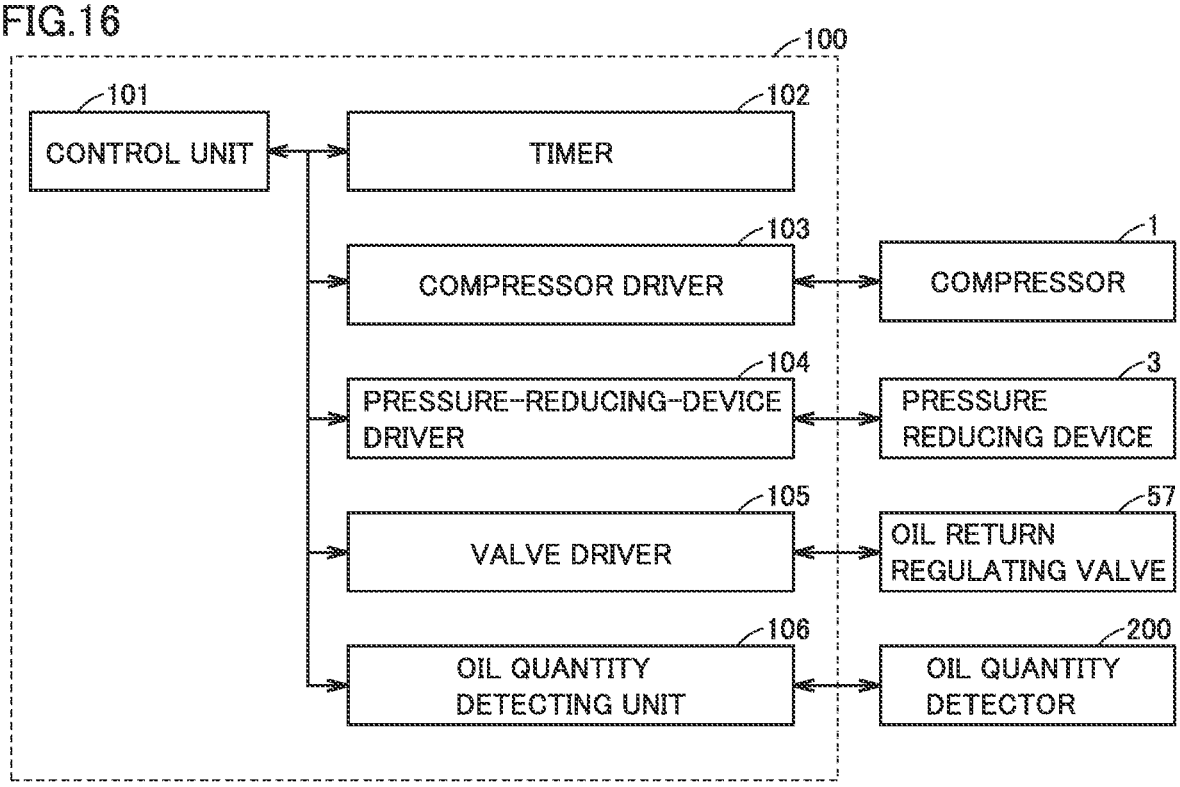
FIG. 16 is a functional block diagram of a refrigeration cycle apparatus according to embodiment 2 of the present invention.

With reference to FIG. 14 to FIG. 16, the configuration of a refrigeration cycle apparatus in embodiment 2 of the present invention is described. Unless otherwise noted, embodiment 2 of the present invention has the same configuration as embodiment 1 of the present invention described above. Thus, identical components are identically denoted, and the explanation of the components is not repeated. Oil separation device 5 in the present embodiment is different from that in embodiment 1 mainly in that oil separation device 5 in the present embodiment includes an oil quantity detector 200.

As shown in FIG. 14 and FIG. 15, the refrigeration cycle apparatus in the present embodiment includes oil quantity detector 200. Examples of oil quantity detector 200 include a capacitance sensor, a self-heating sensor, an ultrasonic sensor, and an optical sensor. The capacitance sensor detects the oil quantity by detecting the capacitance between electrodes inserted in the container and distinguishing between a gas and a liquid. The self-heating sensor detects the oil quantity based on the temperature change in the container heated by resistance heating. The ultrasonic sensor detects the oil quantity by measuring the velocity of transmission of sound. The optical sensor detects the oil quantity by measuring the transmittance of light.

Oil quantity detector 200 is disposed on storage chamber 59. Oil quantity detector 200 is located at the position at which the quantity of refrigeration oil in storage chamber 59 is a prescribed oil quantity. The prescribed oil quantity is, for example, a surplus oil quantity. In order to prevent the depletion of refrigeration oil at the time of, for example, start-up, the quantity of refrigeration oil enclosed in compressor 1 is larger than the proper oil quantity for the stable time. In the stable time, since refrigeration oil is less likely to be depleted, surplus refrigeration oil is enclosed in compressor 1. The surplus oil quantity at this time is set as the prescribed oil quantity.

For example, when an enclosed oil quantity Mtotal is larger than an oil quantity Mcomp at the time when the oil is full to the lower end of the motor in compressor 1 (Mcomp<Mtotal), then the prescribed oil quantity (surplus oil quantity) is obtained by subtracting oil quantity Mcomp from enclosed oil quantity Mtotal (Mtotal− Mcomp). The refrigeration oil in excess of oil quantity Mcomp is brought out of compressor 1 into the refrigeration circuit.

The prescribed oil quantity may be constant, or may be variable depending on the frequency of compressor 1, the refrigerant flow rate, and the inlet and outlet pressures of compressor 1.

As shown in FIG. 16, control device 100 includes an oil quantity detecting unit 106. Oil quantity detecting unit 106 is for detecting the quantity of refrigeration oil in storage chamber 59 based on the signal from oil quantity detector 200. In the storing mode, control device 100 controls oil return regulating valve 57 to regulate the oil quantity based on the detection value detected by oil quantity detector 200.

Next, with reference to FIG. 14 and FIG. 15, the operation of refrigeration cycle apparatus 10 in the present embodiment is described.

As shown in FIG. 14 and FIG. 15, in refrigeration cycle apparatus 10 in the present embodiment, in the oil return mode, the refrigeration oil flows in the same manner as in embodiment 1. In the storing mode, the refrigeration oil separated in separation chamber 58 flows into storage chamber 59, in the same manner as in the oil return mode.

The refrigeration oil that has flowed into storage chamber 59 flows into oil return pipe 53. When the quantity of refrigeration oil that has flowed into storage chamber 59 is less than the prescribed oil quantity, the quantity of refrigeration oil flowing into oil return pipe 53 is decreased. Thus, the refrigeration oil accumulates in storage chamber 59 to increase the liquid level in storage chamber 59. When the liquid level increases so that the quantity of refrigeration oil is equal to or more than the prescribed oil quantity, the quantity of refrigeration oil flowing into oil return pipe 53 is increased. That is, the quantity of refrigeration oil flowing into oil return pipe 53 varies so that the quantity of refrigeration oil in storage chamber 59 is equal to the prescribed oil quantity. The refrigeration oil that has flowed into oil return pipe 53 is returned to compressor 1 by the same route as that in the oil return mode.

Figure 17:
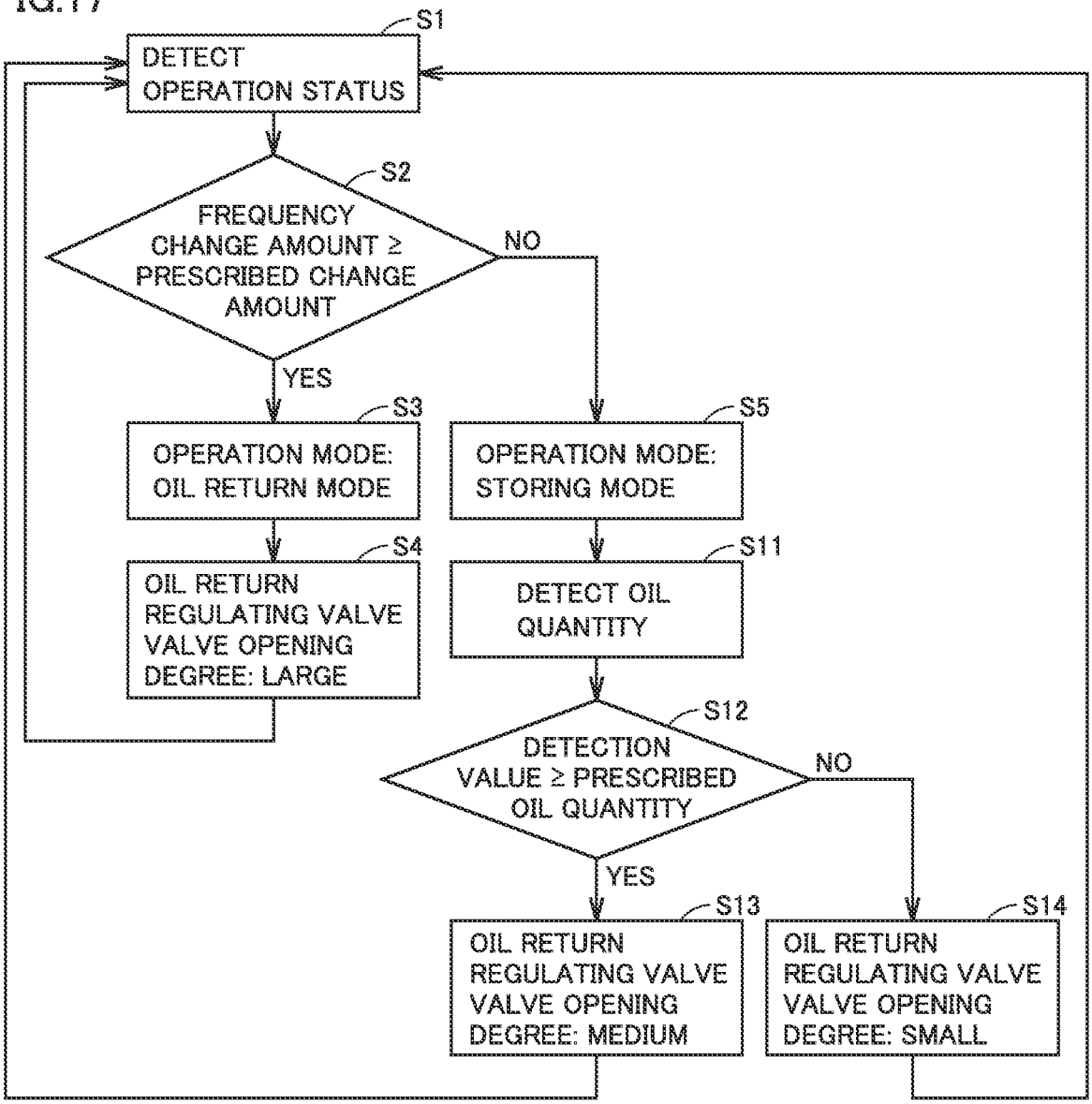
FIG. 17 is a flowchart showing the operation of a refrigeration cycle apparatus according to embodiment 2 of the present invention.

With reference to FIG. 16 and FIG. 17, the switching of the operation mode of refrigeration cycle apparatus 10 in the present embodiment will now be described.

First, the operation status of refrigeration cycle apparatus 10 is detected (step S1). Then, it is determined whether or not the frequency change amount of compressor 1 is equal to or more than a prescribed change amount (step S2). This determination is performed by control unit 101 based on the signals from timer 102 and compressor driver 103. When the frequency change amount of compressor 1 is equal to or more than the prescribed change amount, the operation mode is switched to the oil return mode (step S3). In the oil return mode, oil return regulating valve 57 is controlled to have a large valve opening degree by valve driver 105 based on the signal from control unit 101 (step S4). On the other hand, when the frequency change amount of compressor 1 is less than the prescribed change amount, the operation mode is switched to the storing mode (step S5). Oil quantity detecting unit 106 detects the oil quantity based on the signal from oil quantity detector 200 (step S6).

Then, it is determined whether or not the detection value of the oil quantity is equal to or more than a prescribed oil quantity (step S12). This determination is performed by control unit 101 based on the signal from oil quantity detecting unit 106. When the detection value of the oil quantity is equal to or more than the prescribed oil quantity, oil return regulating valve 57 is controlled to have a medium valve opening degree by valve driver 105 based on the signal from control unit 101 (step S13). When the detection value of the oil quantity is less than the prescribed oil quantity, oil return regulating valve 57 is controlled to have a small valve opening degree by valve driver 105 based on the signal from control unit 101 (step S14).

Next, the advantageous effects of the present embodiment are described.

According to oil separation device 5 in the present embodiment, the oil quantity is detected by oil quantity detector 200. Oil return regulating valve 57 is configured to have a larger valve opening degree when the detection value detected by oil quantity detector 200 is equal to or more than the prescribed oil quantity, than when the detection value detected by oil quantity detector 200 is less than the prescribed oil quantity. Accordingly, at all times, a proper quantity of refrigeration oil for each operation status can be stored in storage chamber 59.

The prescribed oil quantity may vary depending on the frequency of compressor 1, the refrigerant flow rate, and the inlet and outlet pressures of compressor 1. In such a case, the proper quantity for each operation status is recorded by the sensor that determines the operation status, and oil return regulating valve 57 is controlled based on the record. Accordingly, at all times, the refrigeration oil quantity can be controlled to be a proper quantity.

Embodiment 3

Figure 18:
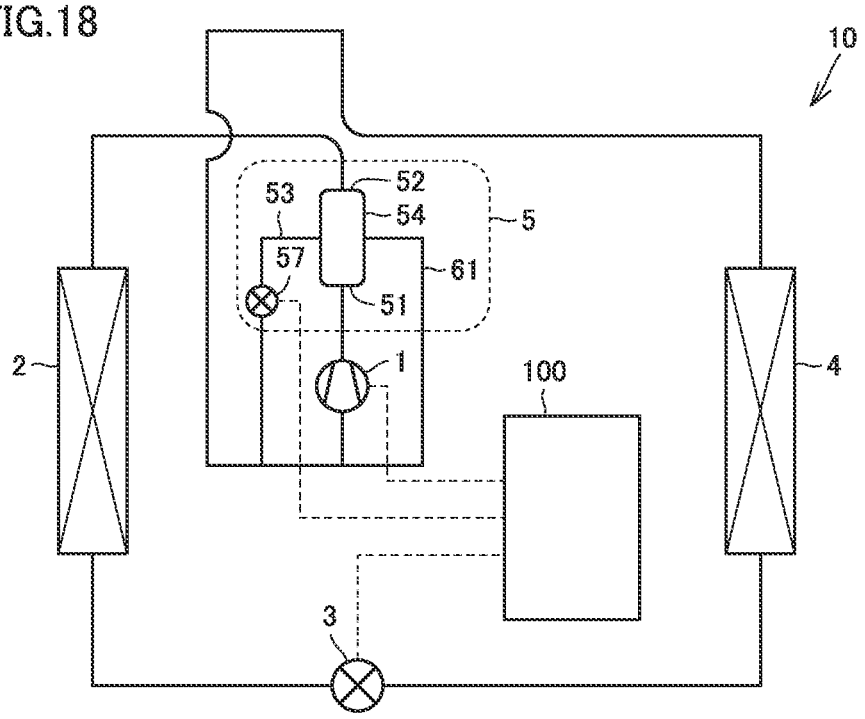
FIG. 18 is a refrigerant circuit diagram of a refrigeration cycle apparatus according to embodiment 3 of the present invention.
Figure 19:
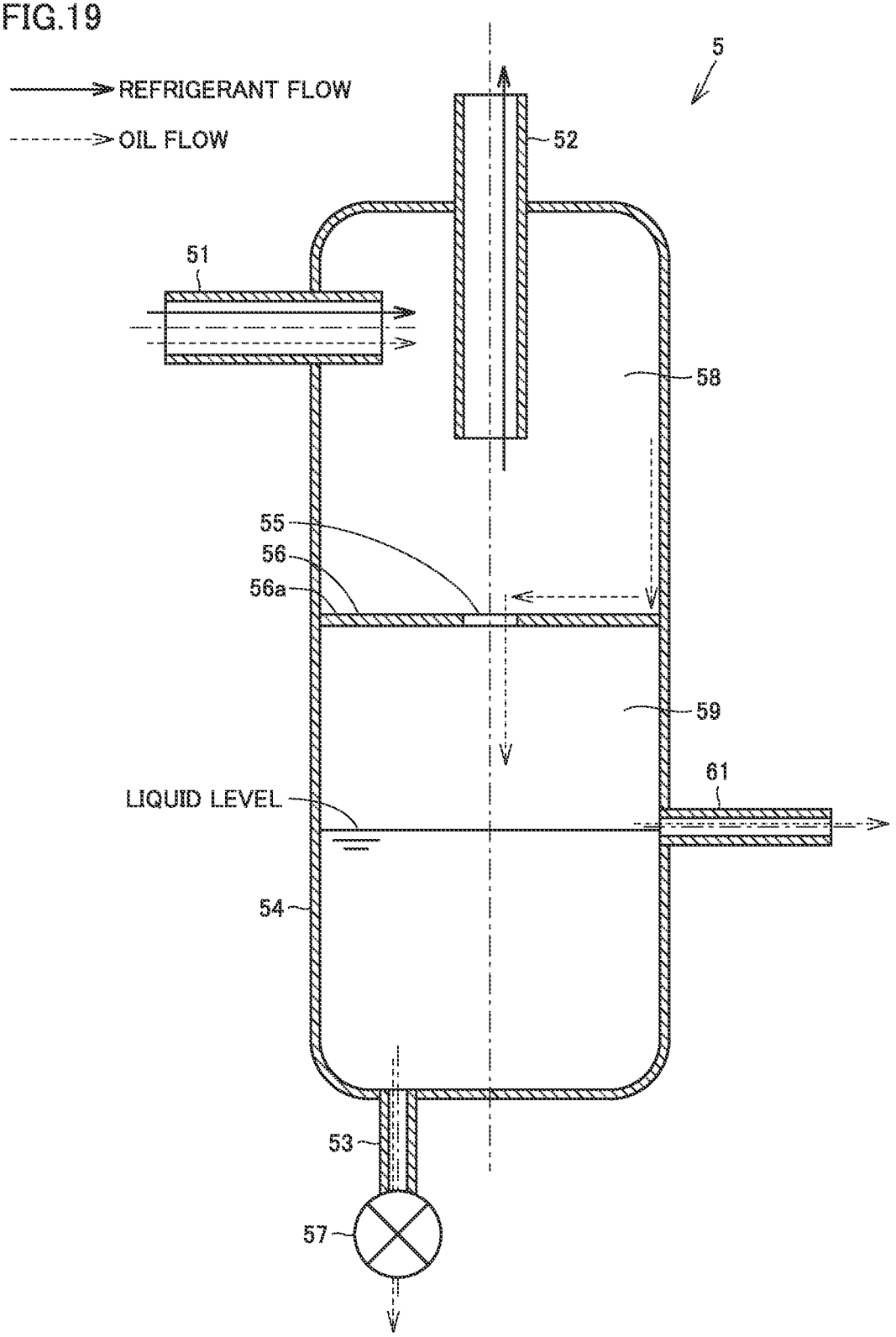
FIG. 19 is a cross-sectional view of an oil separation device according to embodiment 3 of the present invention.

With reference to FIG. 18 and FIG. 19, the configuration of a refrigeration cycle apparatus in embodiment 3 of the present invention is described. Unless otherwise noted, embodiment 3 of the present invention has the same configuration as embodiment 1 of the present invention described above. Thus, identical components are identically denoted, and the explanation of the components is not repeated. The oil separation device in the present embodiment is different from that in embodiment 1 mainly in that the oil separation device in the present embodiment includes a bypass pipe 61.

As shown in FIG. 18 and FIG. 19, the refrigeration cycle apparatus in the present embodiment includes bypass pipe 61. Bypass pipe 61 is connected to storage chamber 59. Bypass pipe 61 is connected to storage chamber 59 between partition portion 56 and oil return pipe 53 in the height direction. Bypass pipe 61 is located below partition portion 56.

One end of bypass pipe 61 is located at the position corresponding to the prescribed oil quantity (e.g., surplus oil) in storage chamber 59. The other end of bypass pipe 61 is connected, via a pipe, to a low-pressure pipe between compressor 1 and low-pressure-side heat exchanger 4.

Next, the operation of refrigeration cycle apparatus 10 in the present embodiment is described.

In refrigeration cycle apparatus 10 in the present embodiment, in the oil return mode, the refrigeration oil flows in the same manner as in embodiment 1. However, when the flow rate of refrigeration oil separated from separation chamber 58 is higher than the flow rate into oil return pipe 53, there is a risk of an overflow in which the refrigeration oil accumulates in storage chamber 59 so that the liquid level increases up to separation chamber 58 and further up to outlet pipe 52. Accordingly, in refrigeration cycle apparatus 10 in the present embodiment, when the quantity of refrigeration oil reaches a prescribed oil quantity in storage chamber 59, the refrigeration oil flows into bypass pipe 61. This prevents an overflow. The refrigeration oil that has flowed into bypass pipe 61 flows into the low-pressure pipe between low-pressure-side heat exchanger 4 and compressor 1. The oil that has flowed into the low-pressure pipe flows into compressor 1.

In the storing mode, the refrigeration oil separated in the same manner as in the oil return mode flows into storage chamber 59. The refrigeration oil that has flowed into storage chamber 59 flows into oil return pipe 53. When the quantity of refrigeration oil is less than the prescribed oil quantity, the quantity of refrigeration oil flowing into oil return pipe 53 is decreased. Thus, the refrigeration oil accumulates in storage chamber 59 to increase the liquid level in storage chamber 59. When the liquid level increases so that the quantity of refrigeration oil is equal to or more than the prescribed oil quantity, the refrigeration oil flows into bypass pipe 61. The refrigeration oil that has flowed into oil return pipe 53 and bypass pipe 61 flows into compressor 1 by the same route as that in the oil return mode.

Next, the advantageous effects of the present embodiment are described.

According to oil separation device 5 in the present embodiment, when the liquid level of refrigeration oil in storage chamber 59 increases to the position of the prescribed oil quantity, the refrigeration oil flows into bypass pipe 61. This can prevent an overflow in which the liquid level increases up to separation chamber 58 or outlet pipe 52.

Embodiment 4

Figure 20:
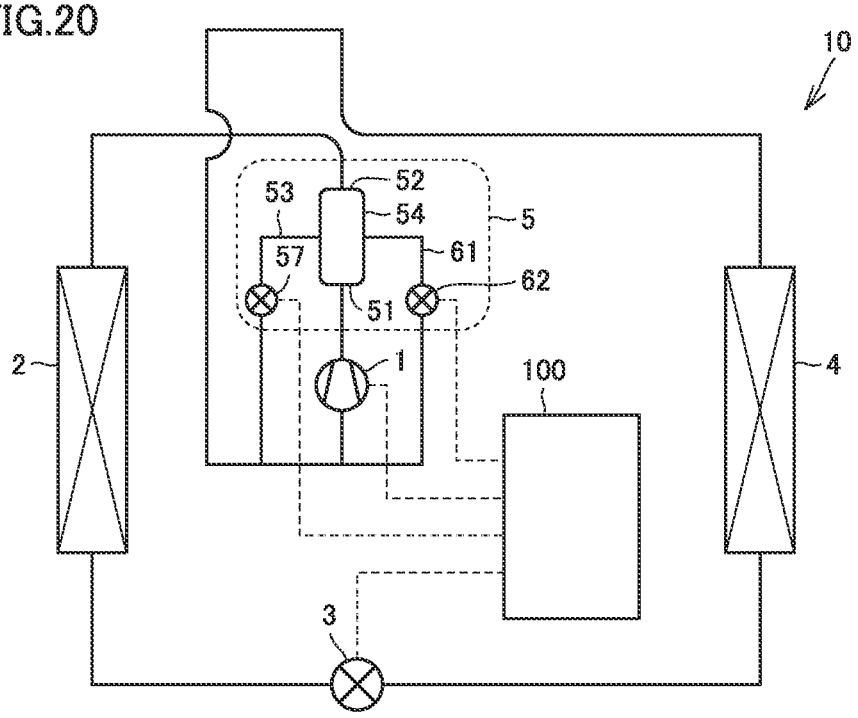
FIG. 20 is a refrigerant circuit diagram of a refrigeration cycle apparatus according to embodiment 4 of the present invention.
Figure 21:
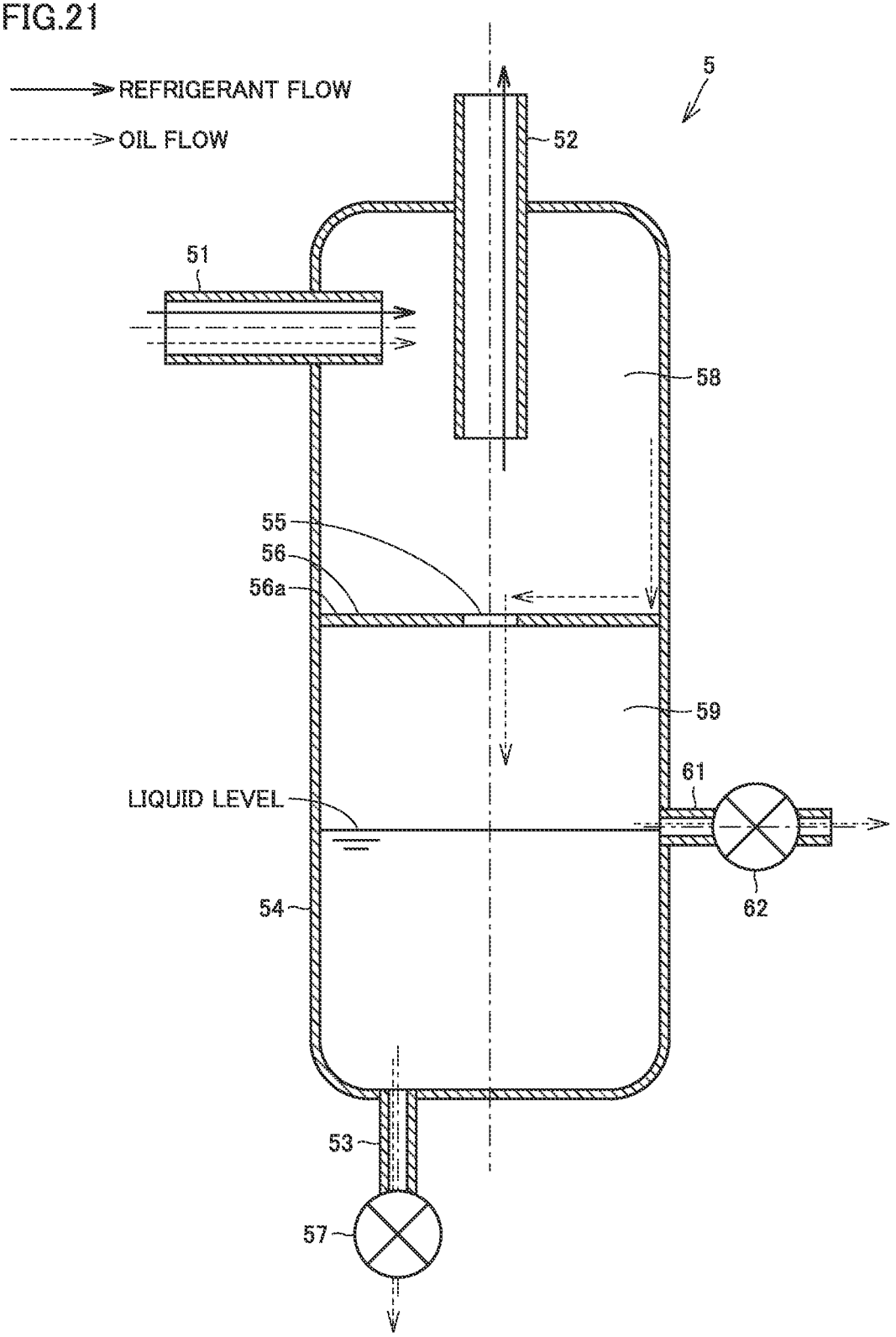
FIG. 21 is a cross-sectional view of an oil separation device according to embodiment 4 of the present invention.
Figure 22:
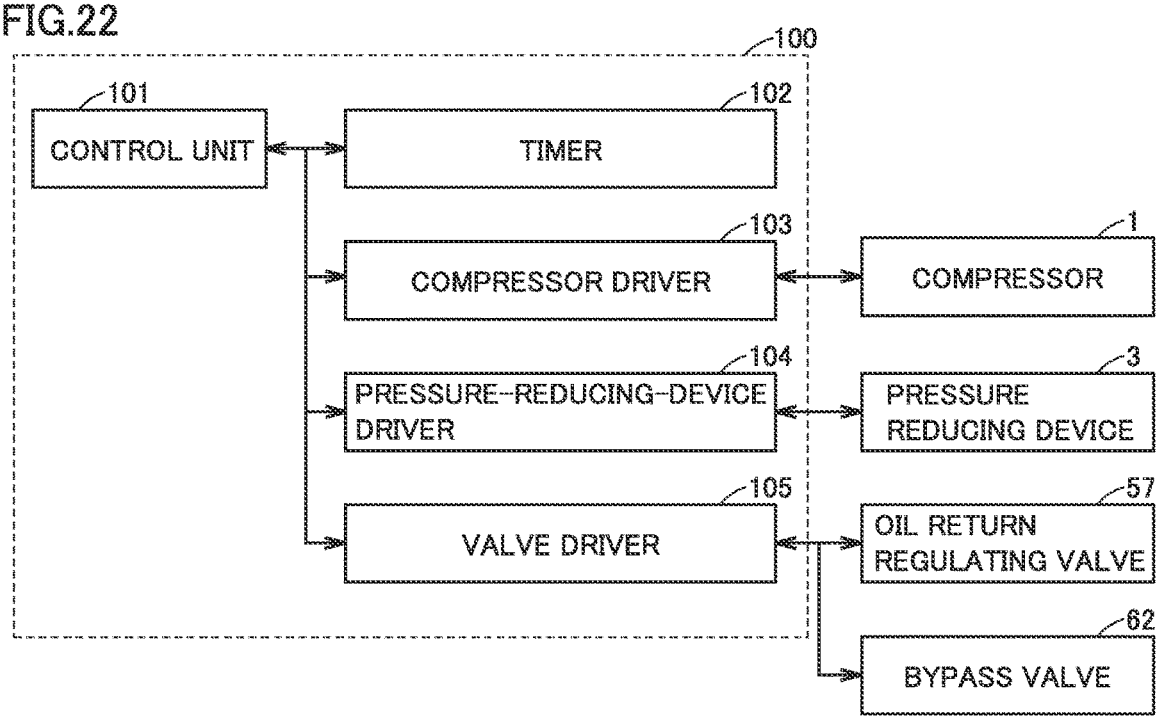
FIG. 22 is a functional block diagram of a refrigeration cycle apparatus according to embodiment 4 of the present invention.

With reference to FIG. 20 to FIG. 22, the configuration of a refrigeration cycle apparatus in embodiment 4 of the present invention is described. Unless otherwise noted, embodiment 4 of the present invention has the same configuration as embodiment 3 of the present invention described above. Thus, identical components are identically denoted, and the explanation of the components is not repeated. The oil separation device in the present embodiment is different from that in embodiment 3 mainly in that the oil separation device in the present embodiment includes a bypass valve 62.

As shown in FIG. 20 and FIG. 21, the refrigeration cycle apparatus in the present embodiment includes bypass valve 62. Bypass valve 62 is disposed on bypass pipe 61. Bypass valve 62 is configured to close when the frequency change amount of compressor 1 is less than a prescribed change amount, and is configured to open when the frequency change amount of compressor 1 is equal to or more than the prescribed change amount.

As shown in FIG. 22, valve driver 105 is for driving bypass valve 62 based on the signal from control unit 101. Specifically, valve driver 105 controls the valve opening degree of bypass valve 62 by controlling a driving source, such as a motor, attached to bypass valve 62.

Next, the operation of refrigeration cycle apparatus 10 in the present embodiment is described.

In refrigeration cycle apparatus 10 in the present embodiment, in the oil return mode, the refrigeration oil flows in the same manner as in embodiment 3. In refrigeration cycle apparatus 10 in the present embodiment, when the quantity of refrigeration oil reaches a prescribed oil quantity in storage chamber 59, the refrigeration oil flows into bypass pipe 61.

In the storing mode, the refrigeration oil separated in the same manner as in the oil return mode flows into storage chamber 59. When the quantity of refrigeration oil is less than the prescribed oil quantity, the quantity of refrigeration oil flowing into oil return pipe 53 is decreased. When the liquid level of refrigeration oil in storage chamber 59 increases so that the quantity of refrigeration oil is equal to or more than the prescribed oil quantity, the refrigeration oil flows into bypass pipe 61. The refrigeration oil that has flowed into oil return pipe 53 and bypass pipe 61 flows into compressor 1 by the same route as that in the oil return mode.

Figure 23:
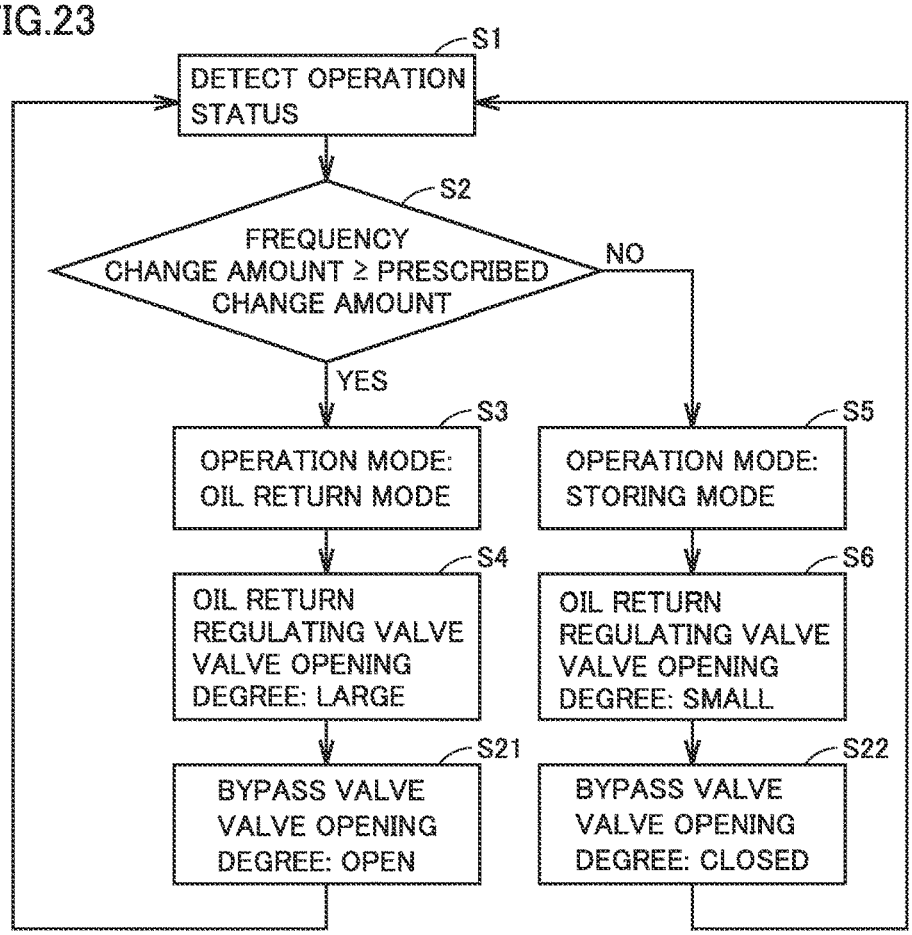
FIG. 23 is a flowchart showing the operation of a refrigeration cycle apparatus according to embodiment 4 of the present invention.

With reference to FIG. 22 and FIG. 23, the switching of the operation mode of refrigeration cycle apparatus 10 in the present embodiment will now be described.

First, the operation status of refrigeration cycle apparatus 10 is detected (step S1). Then, it is determined whether or not the frequency change amount of compressor 1 is equal to or more than a prescribed change amount (step S2). This determination is performed by control unit 101 based on the signals from timer 102 and compressor driver 103. When the frequency change amount of compressor 1 is equal to or more than the prescribed change amount, the operation mode is switched to the oil return mode (step S3). In the oil return mode, oil return regulating valve 57 is controlled to have a large valve opening degree by valve driver 105 based on the signal from control unit 101 (step S4). Also, bypass valve 62 is controlled to open by valve driver 105 based on the signal from control unit 101 (step S21).

On the other hand, when the frequency change amount of compressor 1 is less than the prescribed change amount, the operation mode is switched to the storing mode (step S5). In the storing mode, oil return regulating valve 57 is controlled to have a small valve opening degree by valve driver 105 based on the signal from control unit 101 (step S6). Also, bypass valve 62 is controlled to close by valve driver 105 based on the signal from control unit 101 (step S22).

Next, the advantageous effects of the present embodiment are described.

According to oil separation device 5 in the present embodiment, when the liquid level of refrigeration oil in storage chamber 59 increases to the position of the prescribed oil quantity, bypass valve 62 is opened so that the refrigeration oil flows out through bypass pipe 61. This can prevent an overflow in which the liquid level increases up to separation chamber 58 or outlet pipe 52.

According to oil separation device 5 in the present embodiment, in the stable time of the operation status (storing mode), bypass valve 62 is closed so that the refrigerant gas that has flowed into bypass pipe 61 can flow into outlet pipe 52. This can prevent the degradation in heat-transfer performance.

The features of the present embodiments may be combined as appropriate.

It should be understood that the embodiments disclosed herein are by way of example in every respect and without limitation. The scope of the present invention is defined not by the above description but by the terms of the claims, and is intended to include any modification within the meaning and scope equivalent to the terms of the claims.

The invention claimed is:

1. An oil separation device for separating a refrigeration oil from a fluid mixture of refrigerant and the refrigeration oil discharged from a compressor, the oil separation device comprising:

a container including a separation chamber for separating the refrigeration oil from the fluid mixture of refrigerant and the refrigeration oil, a storage chamber for storing the refrigeration oil separated from the fluid mixture of refrigerant and the refrigeration oil, and a partition portion partially separating the separation chamber and the storage chamber from each other;

an inlet pipe configured to allow the fluid mixture of refrigerant and the refrigeration oil to flow into the separation chamber of the container;

an outlet pipe configured to allow a refrigerant to flow out of the separation chamber, the refrigerant being separated from the fluid mixture of refrigerant and the refrigeration oil that flows into the separation chamber through the inlet pipe;

an oil return pipe configured to return the refrigeration oil from the storage chamber to the compressor, the refrigeration oil being separated from the refrigerant that flows out through the outlet pipe; and an oil return regulating valve connected to the oil return pipe, the partition portion being configured to allow the refrigeration oil to flow from the separation chamber to the storage chamber, the refrigeration oil being separated from the fluid mixture of refrigerant and the refrigeration oil, the oil return regulating valve being configured to adjust an amount of the refrigeration oil that is returned from the storage chamber to the compressor so as to prevent an occurrence of an overflow in which a liquid level of the refrigeration oil stored in the storage chamber exceeds a level of the partition portion, wherein the oil return regulating valve is configured to have a larger valve opening degree when a frequency change amount of the compressor is equal to or more than a prescribed change amount, than when the frequency change amount of the compressor is less than the prescribed change amount.

2. The oil separation device according to claim 1, wherein the partition portion includes a partition plate separating the separation chamber and the storage chamber from each other, and an opening provided in the partition plate and configured to allow communication between the separation chamber and the storage chamber.

3. The oil separation device according to claim 2, wherein the container includes an inner wall surface, and the opening is provided between the inner wall surface of the container and the partition plate.

4. The oil separation device according to claim 2, wherein the inlet pipe includes an inlet opening configured to allow the fluid mixture of refrigerant and the refrigeration oil to flow into the separation chamber, and the opening is located directly below the inlet opening.

5. The oil separation device according to claim 1, wherein the partition portion includes a trapping material having a porosity such that the trapping material is permeable to the refrigeration oil, and the partition portion is configured so that the refrigeration oil flows from the separation chamber to the storage chamber through the trapping material.

6. The oil separation device according to claim 1, further comprising an oil quantity detector configured to detect a quantity of the refrigeration oil stored in the storage chamber, wherein the oil return regulating valve is configured to have the larger valve opening degree when a detection value detected by the oil quantity detector is equal to or more than a prescribed oil quantity, than when the detection value detected by the oil quantity detector is less than the prescribed oil quantity.

7. The oil separation device according to claim 1, further comprising a bypass pipe connected to the storage chamber, wherein the bypass pipe is connected to the storage chamber between the partition portion and the oil return pipe in a height direction.

8. The oil separation device according to claim 7, further comprising a bypass valve disposed on the bypass pipe, wherein the bypass valve is configured to close when the frequency change amount of the compressor is less than the prescribed change amount, and configured to open when the frequency change amount of the compressor is equal to or more than the prescribed change amount.

9. A refrigeration cycle apparatus comprising:

the oil separation device according to claim 1; and the compressor configured to discharge the fluid mixture of refrigerant and the refrigeration oil.

10. A refrigeration cycle apparatus comprising:

the oil separation device according to claim 1; and a controller configured to detect an operation status of the compressor;

determine whether the frequency change amount of the compressor is equal to or more than the prescribed change amount;

switch an operation mode of the compressor to an oil return mode and control the oil return regulating valve to have the larger valve opening degree, when the frequency change amount of the compressor is equal to or more than the prescribed change amount, and switch the operation mode of the compressor to a storing mode and control the oil return regulating valve to have a smaller valve opening degree then in the oil return mode, when the frequency change amount of the compressor is less than the prescribed change amount.

* * * * *